US006328090B1

(12) United States Patent
Anderson et al.

(10) Patent No.: US 6,328,090 B1
(45) Date of Patent: Dec. 11, 2001

(54) FRAMED COVERING FOR ARCHITECTURAL OPENING

(75) Inventors: Richard N. Anderson, Whitesville, KY (US); Terrence M. Drew, Superior, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/687,334

(22) Filed: Oct. 13, 2000

Related U.S. Application Data

(60) Provisional application No. 60/181,367, filed on Feb. 8, 2000.

(51) Int. Cl.[7] ..... E06B 3/32

(52) U.S. Cl. ..... 160/84.05; 160/107

(58) Field of Search ..... 160/107, 84.05, 160/84.06, 172 R, 344, 345, 167 R, 84.02, 9 D

(56) References Cited

U.S. PATENT DOCUMENTS

| | | | | |
|---|---|---|---|---|
| 2,607,963 | * | 8/1952 | Ansel | 160/107 X |
| 3,253,644 | * | 5/1966 | Gotoh et al. | 160/107 |
| 3,318,360 | * | 5/1967 | Persson | 160/107 |
| 3,443,624 | * | 5/1969 | Toth | 160/107 |
| 3,478,807 | * | 11/1969 | Hertzberg | 160/344 |
| 3,795,267 | * | 3/1974 | Debs | 160/107 X |
| 4,611,648 | | 9/1986 | Anderson | 160/107 |
| 4,679,610 | * | 7/1987 | Spraggins | 160/107 |
| 5,082,043 | * | 1/1992 | Moreno | 160/84.06 X |
| 5,195,569 | * | 3/1993 | Peterson et al. | 160/84.06 |
| 5,282,504 | | 2/1994 | Anderson et al. | 160/107 |

* cited by examiner

*Primary Examiner*—David M. Purol
(74) *Attorney, Agent, or Firm*—Dorsey & Whitney LLP

(57) ABSTRACT

A framed covering for an architectural opening includes a collapsible shade that is moveable between open and closed positions relative to the architectural opening with the collapsible shade being mounted within an enclosed framework that is adapted to be secured to a structural member having the architectural opening therein. In one embodiment of a flexible control cord system moves the shade between open and closed positions, with the control cord system being conveniently positioned adjacent the frame for easy manipulation. In a second embodiment a finger slide on the frame drives a cord lift system for moving the covering between open and closed positions.

6 Claims, 22 Drawing Sheets

338
350
343
336
22
22
306
332
182
352
356
340
342
21
21
354
306
180
160
322
328
20
20
327
178

306
308
322
324
184
308
322

306
308
322
178
324
184
322

327
184
324
326

306
184
20A
308
326
327
178
328
308
324
304
306
382
20A
380

182
306
308
310
312
314
316
320
322
324
380
382
27
28
26

178
352
354
356
358
360
362
31
34
35

FRAMED COVERING FOR ARCHITECTURAL OPENING

CROSS-REFERENCE TO RELATED APPLICATIONS

This application is a non-provisional application claiming priority to U.S. application Ser. No. 60/181,367 filed Feb. 8, 2000.

BACKGROUND OF THE INVENTION

1. Field of the Invention

The present invention relates generally to coverings for architectural openings and more particularly to a covering that is housed within a frame and adapted to be secured to a building structure in an architectural opening.

2. Description of Relevant Art

Coverings for architectural openings have taken numerous forms for many years with early coverings simply being draperies that were draped around or across architectural openings such as windows, doorways, archways and the like. Through the years, coverings for architectural openings have assumed more modern looks and today include retractable draperies, curtains and various types of cellular or slatted covering such as venetian blinds and vertical blinds, all of which can be extended across an architectural opening or retracted to a side or sides of the opening.

Most coverings for architectural openings are freely suspended and hang by gravity and such an arrangement is satisfactory when the architectural opening itself is fixed, as the covering retains its relationship to the opening at all times. However, when an architectural opening is in a movable part of a building structure, for example, in a door or movable partition, unless the covering on the opening is confined, it will swing freely as the door or partition is moved, which can become a nuisance thereby discouraging people from using coverings on openings in such movable structures.

Also, whether or not the architectural opening is in a movable part of a building structure, it is sometimes undesirable to have pull cords, tilt wands or the like for operating the covering, with such cords and wands typically hanging freely adjacent one or both sides of the architectural opening. Such pull cords and wands are undesirable aesthetically to some people and, furthermore, pull cords have posed a hazard for young children who have been known to have body parts entangled in the pull cords causing bodily harm.

The present invention has been designed to overcome the problems previously associated with using a covering on an opening in a movable structure and to overcome shortcomings associated with dangling pull cords, tilt wands and the like.

SUMMARY OF THE INVENTION

One embodiment of the framed covering for architectural openings of the present invention includes an outer framework adapted to extend around the periphery or some portion of an architectural opening and a transparent or translucent panel supported by the framework so as to form an enclosure around the architectural opening. Within the enclosure, a collapsible shade is supported by the framework and movable between a closed position wherein it extends across the area defined by the frame and a retracted position adjacent one side of the frame. A control system in the form of a flexible cord or the like is operatively secured to the collapsible shade to move it between the open and closed positions with the control element extending through an opening in the framework for access by an operator of the shade. A stop is provided for retaining the shade in the closed position while gravity would normally move the shade from the closed to the open position, even though a reverse system could be employed.

In another embodiment of the present invention, a pull cord system is utilized to extend and retract a collapsible shade across a framed opening, but the pull cord system itself is operated by a finger slide disposed in the framework with operation of the covering being achieved simply through a sliding movement of the finger slide along the frame. The system is designed such that a relatively short stroke of the finger slide effects a greater movement of the covering so that the covering can be extended across the full architectural opening through a stroke of the finger that is less than the full dimension of the architectural opening.

Other aspects, features and details of the present invention can be more completely understood by reference to the following detailed description of a preferred embodiment, taken in conjunction with the drawings and from the appended claims.

DESCRIPTION OF THE PREFERRED EMBODIMENT

Figure 1:
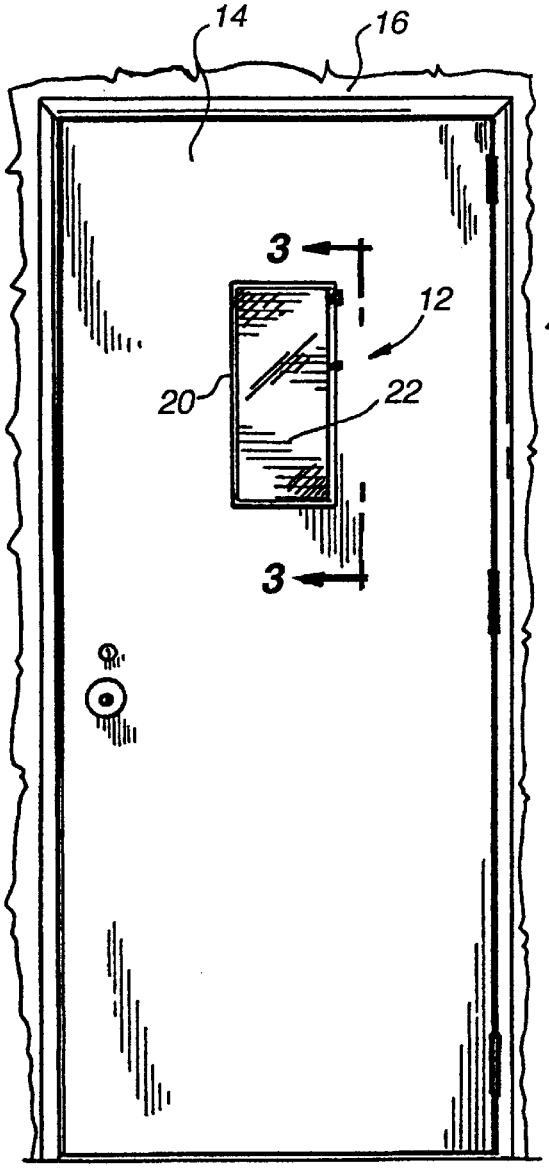
FIG. 1 is a fragmentary front elevation of a door having a window therethrough and one embodiment of the framed architectural covering of the present invention mounted thereon.
Figure 2:
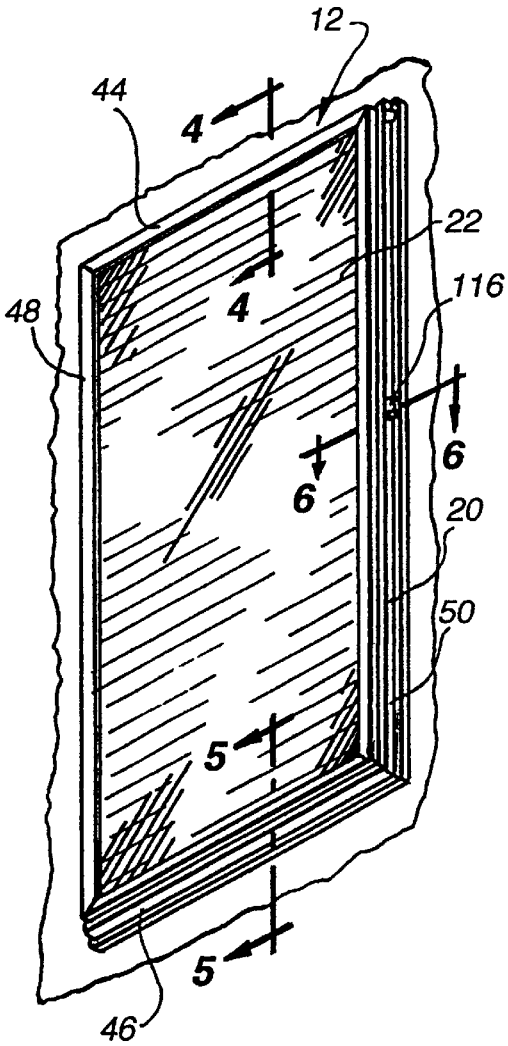
FIG. 2 is a fragmentary isometric of the framed covering shown in FIG. 1.
Figure 3:
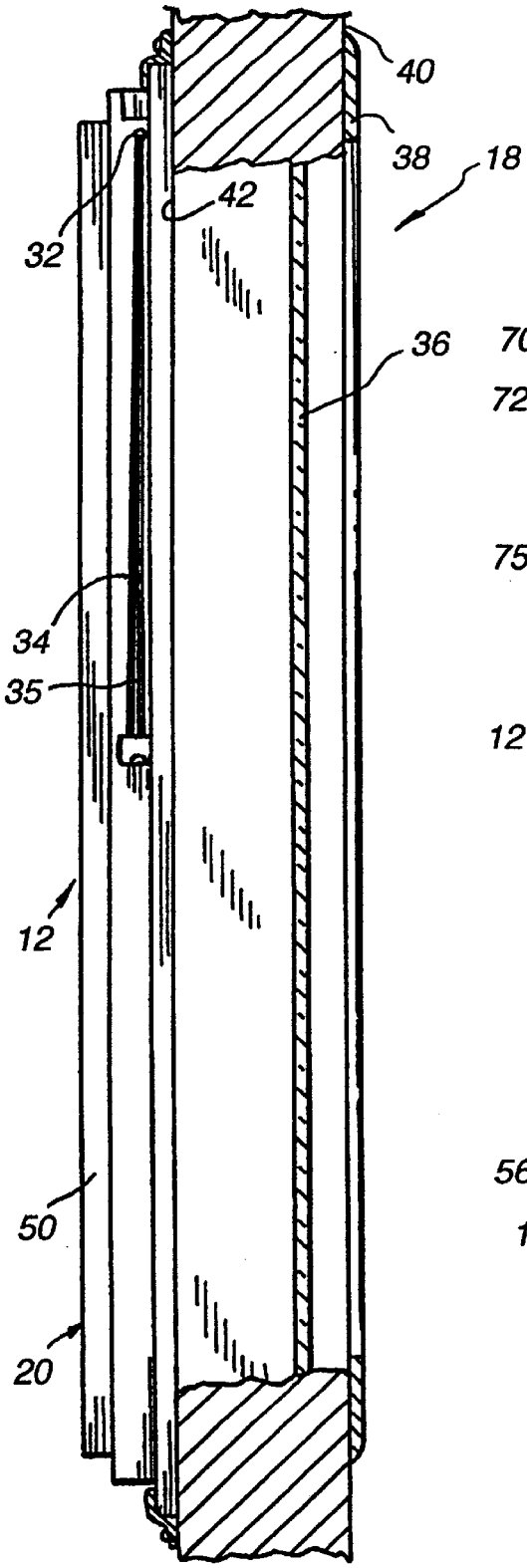
FIG. 3 is an enlarged fragmentary section taken along line 3—3 of FIG. 1.

A first embodiment of the present invention is shown as a framed covering 12 and best seen in FIGS. 1 through 3 mounted on a door 14 of a building stricture 16 in surrounding relationship with a window 18 provided in the door. The framed covering 12 includes an outer rectangular frame 20 which supports internally thereof a collapsible covering system or curtain which in the preferred embodiment includes a cellular shade 22 having a plurality of vertically stacked horizontally extending tubes or cells 24 and a control system 26 (FIG. 11) for manipulating the shade 22. The curtain could be any form of collapsible shade including pleated shades and the like. The shade 22 includes a top or upper rail 28 and a bottom or lower rail 30 and is mounted within the frame 20 so as to be anchored along the lower rail to the frame, with the upper rail being vertically movable to move the shade from a closed position (as seen in FIG. 2) wherein the shade extends across the area defined by the rectangular frame and an open position (not shown) wherein the shade is collapsed with the cells 24 being vertically stacked adjacent the bottom rail. The frame has a passage 32 therethrough to accommodate flexible control elements 34 and 35 of the control system 26 that can be hand manipulated from externally of the frame to move the shade between the open and closed positions.

As illustrated in FIG. 3, the architectural opening or window 18 in the door 14 includes a panel of glass or the like 36 that is fixed in position within a rectangular architectural opening in the door and a frame 38 around the opening mounted on the outer surface 40 of the door provides an aesthetic finish around the glass panel 36. The frame 20 for the covering 12 of the present invention is adapted to be secured to the inner surface 42 of the door also around the rectangular opening in which the glass panel 36 is positioned.

The frame 20 of the present invention is probably best illustrated in FIGS. 3–7 to include identical upper and lower frame members 44 and 46 respectively, as well as left and right side frame members 48 and 50 respectively, with the cross-section of each of the four frame members being identical. In cross-section, each frame member includes an outer step 52, an intermediate step 54 and an inner step 56, with the outer step having one wall 58 that confronts and is parallel to the inner surface 42 of the door and has a recess therein to receive a resilient sealing strip 60 which is compressed against the inner surface of the door. The frame is secured to the door by any type of threaded fastener (not shown) which extends through the recessed wall 58 of the outer step 52 and into the door. The outer step further defines a first wall 62 that is perpendicular to the inner surface 42 of the door and a first wall 64 that is parallel thereto, while the intermediate step 54 defines a second perpendicular wall 66 and a second parallel wall 68 and the inner step 56 defines a third perpendicular wall 70 and a pair of spaced parallel walls 72. The second perpendicular wall 66 forms a perpendicular extension away from the first parallel wall 64 and bifurcates that wall. The third perpendicular wall 70 forms a perpendicular extension away from the distal or free end of the second parallel wall 68. The spaced walls 72 also define a channel around the frame that supports the peripheral edge of a transparent or translucent panel 75 that could be made of any suitable material such as glass or plastic. The panel 75 and the frame 20 thereby cooperate in defining an enclosure that opens toward the window 18 and in which the shade 22 is disposed.

Figure 9:
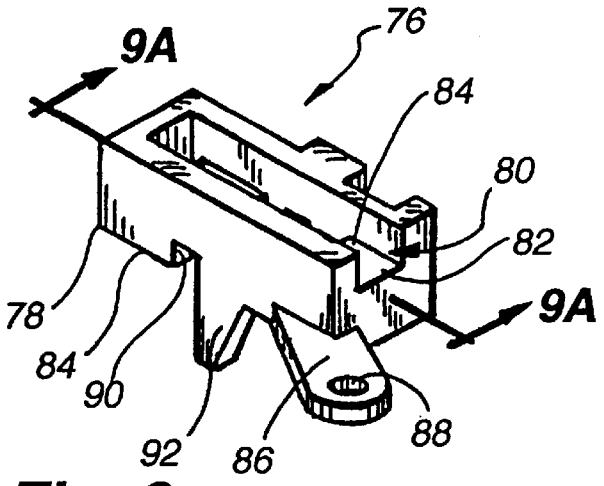
FIG. 9 is an isometric looking downwardly on a clip used in the frame of the present invention to guide the control cords through the frame.
Figure 9A:
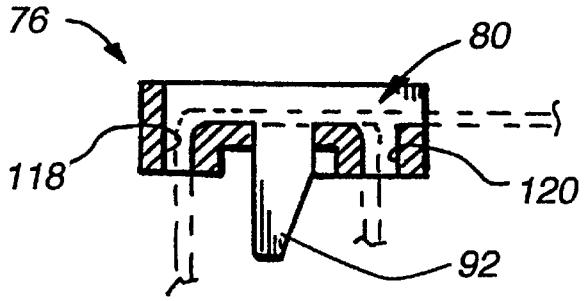
FIG. 9A is a section taken along line 9A—9A of FIG. 9.

The individual frame members are beveled at each end so that the corners of the frame 20 are mitered to give a finished look to the frame. The top end of each of the left and right frame members is notched in the second perpendicular wall 66 on the intermediate step 54 to provide a seat for clips 76 which, as will be discussed later, are adapted to cooperate with the flexible control element 34 in the operation of the covering. The clips 76 are identical and are shown in FIG. 9 through FIG. 9A to comprise a plastic block 78 having a U-shaped channel 80 formed therein which opens at 82 through the right end of the clip, as shown in FIG. 9. The U-shaped channel 80 is in communication with separate openings which pass through a bottom wall 84 of the clip for purposes that will become apparent later. The clip also has an attachment arm 86 that protrudes at an acute angle and horizontally from one side and the right end of the clip and has an aperture 88 therethrough for connection to an alignment cord, as will also become more apparent hereafter. A transverse notch 90 is formed in the bottom wall of the clip adjacent to a pair of depending ears 92 and the notch is adapted to receive the second perpendicular wall 66 on the intermediate step 54 in the associated left or right frame member when the clip is seated in the notch 90 formed in the top edge of the frame member. The ears 92 cooperate in holding the clip in a horizontally disposed position on the top of the left or right frame member and with the attachment arm 86 projecting inwardly toward the interior of the area defined by the frame. The clips are, therefore, positively positioned near the top of the frame 20 when the frame is assembled and, therefore, provide adequate stabilization for the flexible control elements 34 and 35 which cooperate therewith in a manner to be described hereafter.

Figure 8:
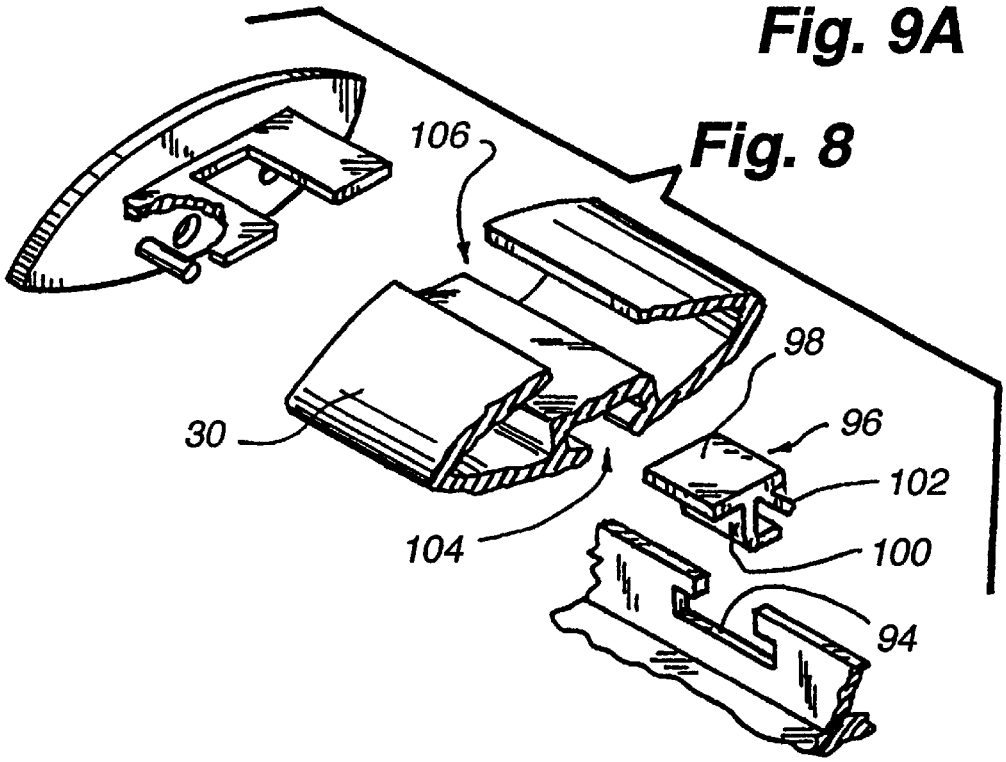
FIG. 8 is an exploded fragmentary isometric illustrating the bottom rail of the covering of the present invention and its connection to the frame of the covering.

Since the collapsible shade 22 in the disclosed embodiment is moved between open and closed positions by moving the top or upper rail 28 of the shade vertically within the frame 20, while the bottom or lower rail 30 of the shade remains stationary, the bottom rail is fixed to the lower frame member 46. The first parallel wall 64 of the bottom frame member 46 is notched, as best seen in FIG. 8, at preferably two locations in an inverted T-shape with the notches 94 being adapted to removably receive anchor clips 96. Each anchor clip 96 has an upper horizontal plate-like portion 98 with a depending L-shaped leg 100 and a depending acute angled leg 102. The plate-like upper portion 98 is slidably received within an open groove 104 formed in the bottom of the bottom rail 30 so that the clip can slide along the length of the bottom rail and be positioned as desired along that length. The groove 104, of course, is of T-shaped cross-section to slidably receive and releasably confine the anchor clip. The depending L-shaped leg 100 of the anchor clip is laterally insertable into the inverted T-shaped notch 94 in the bottom frame member and the acute angled leg 102 of the anchor clip tends to inhibit release of the clip from the inverted T-shaped notch 94. The bottom rail 30 can thereby be releasably secured to the bottom frame member 46 at two spaced locations so as to retain the bottom rail in parallel relationship with the bottom frame member. The clips 96 thereby prevent the bottom frame member from moving during operation of the covering.

The cellular material forming the expandable and collapsible shade portion 22 of the covering is connected to the bottom rail 30 through an elongated open slot 106 formed in the top thereof and the lowermost cell 24*a* in the cellular shade is secured within the interior of the bottom rail in any suitable manner, such as adhesively.

The top rail 28 is identical to the bottom rail 30 only inverted and the uppermost cell 24*b* in the expandable cellular shade 22 is secured to the top rail in the same manner as the lowermost cell is secured to the bottom rail.

As mentioned previously, the movement of the top rail 28 vertically within the frame 20 causes the collapsible shade 22 to move between an open position wherein the cellular shade material is collapsed and stacked adjacent the bottom rail 30 to a closed position wherein the top rail is positioned adjacent the upper frame member 44 and the cellular shade material is expanded and extended across the area defined by the frame. The movement of the top rail from its open position to its closed position is effected by appropriate manipulation of the flexible control elements 34 and 35, while the movement of the top rail from its closed position adjacent the top frame member to its open position adjacent the bottom rail is effected by gravity as will become clearer hereafter.

Figure 11:
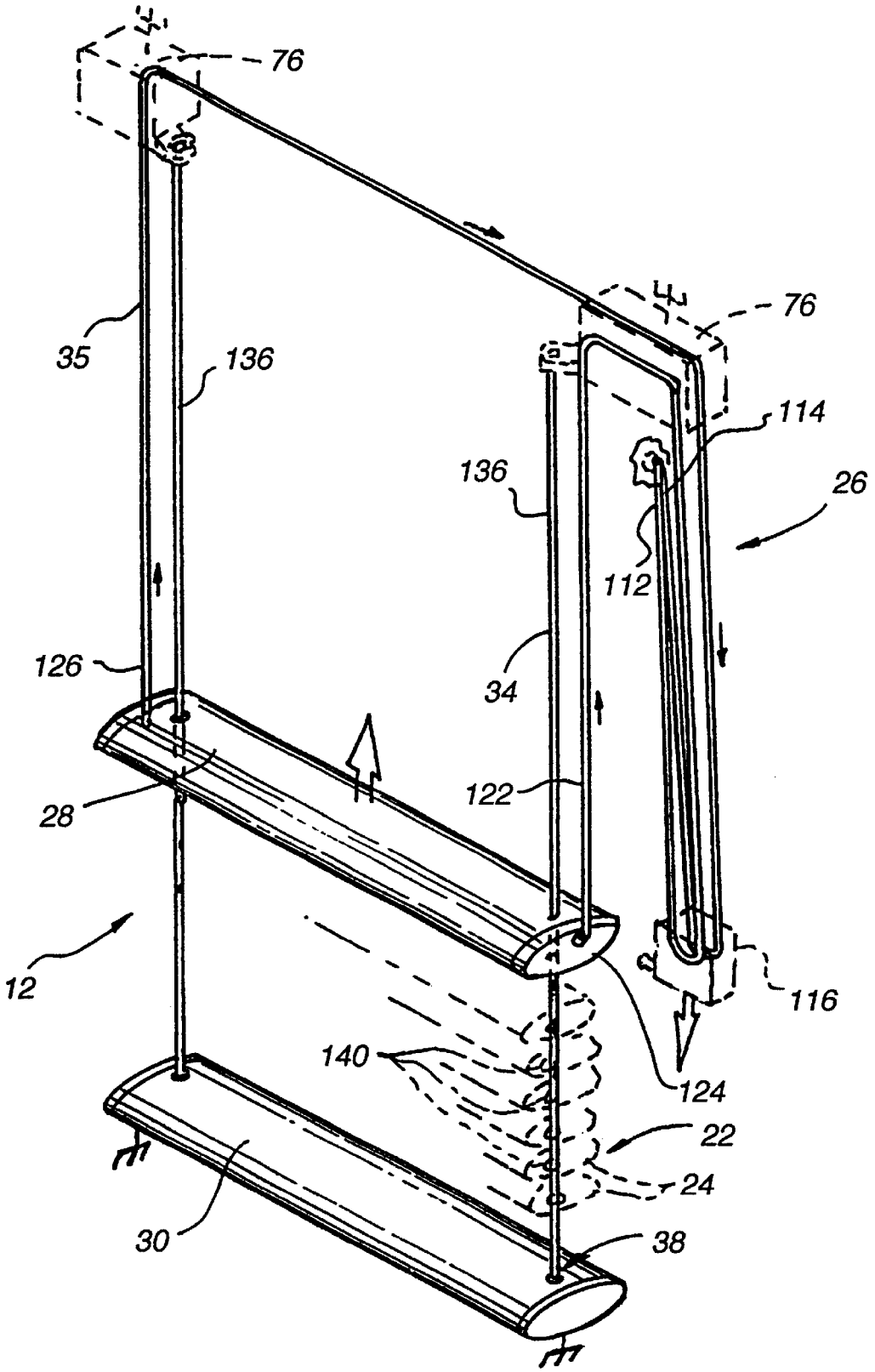
FIG. 11 is a diagrammatic isometric illustrating the interconnection of the control element of the present invention with the collapsible shade component of the covering of the present invention.

The control system 26 in the preferred embodiment consists of the two flexible control elements or cords 34 and 35 of fixed length with both of the cords having first ends 112 and 114 respectively anchored to the right frame member 50, as viewed in FIG. 2, but understood more fully by reference to the diagrammatic view of FIG. 11. The first end of each control cord extends through the passage 32 provided in the second perpendicular wall 66 in the intermediate step 54 near the top of the right frame member, with each cord being knotted on its first end interiorly of the framework. The cords, therefore, extend out of the framework with the first cord 34 extending downwardly through an operating or control tassel 116 and subsequently upwardly and into a first one 118 of the holes in the bottom wall 84 of the clip 76 at the top of the right frame member. The cord 34 then extends horizontally within the U-shaped channel 80 of the clip and passes downwardly through a second one 120 of the holes in the bottom of the same clip. The opposite end 122 of the first control cord is thereafter secured to the upper rail 28 of the collapsible shade 22 by extending the cord downwardly through a hole in an end cap 124 for the upper rail and knotting the end of the cord within the upper rail.

Figure 10:
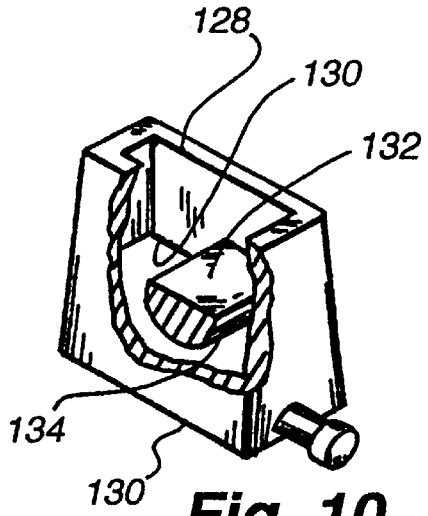
FIG. 10 is an isometric with portions removed illustrating the pull tassel for the control element of the covering of the present invention.

The second control cord 35 extends downwardly from its anchored location in the right frame member 50 and also passes through the control tassel 116 and it, too, then passes upwardly through the first one 118 of the openings in the bottom of the clip 76 in the right frame member. It subsequently passes horizontally through the U-shaped channel 80 in the clip so as to extend out of the open end 82 of the channel and along the upper frame member 44. The second control cord 35 then extends into the open end 82 of the U-shaped channel in the clip 76 at the top of the left frame member 48 and downwardly through the opening 120 in the clip so that the opposite end 126 of the second control cord can be secured to the associated end of the upper rail member in the same manner as the opposite end of the first control cord 108 was secured to the upper rail member. The upper rail member can thereby be moved upwardly within the framework by pulling downwardly on the control tassel 116, which is illustrated in FIG. 10.

The control tassel 116 is merely a trapezoidal block having an open top 128 and bottom 130 and with a transverse bar 132 having a rounded lower surface 134 around which both of the control cords 34 and 35 extend. In other words, each control cord enters the control tassel 116 through the open top 128 and is extended around the transverse bar and, subsequently, leaves the control tassel through the open top. The control cords are, therefore, free to slide relative to the transverse bar during operation of the covering. The control tassel also includes an anchor pin 130 having an enlarged head 132 that extends perpendicularly to the transverse bar 132 and protrudes outwardly from a side wall of the control tassel. The anchor pin is adapted to cooperate with an aperture 134 provided in the second perpendicular wall 66 in the intermediate step 54 of the right frame member 50, with the location of the aperture in the right frame member being predetermined to be in alignment with the control tassel when the collapsible shade 22 is in the raised, closed position. In this manner, the anchor pin 130 can be inserted into the aperture 134 in the right frame member to function as a stop in retaining the shade in the raised and closed position.

Figure 4:
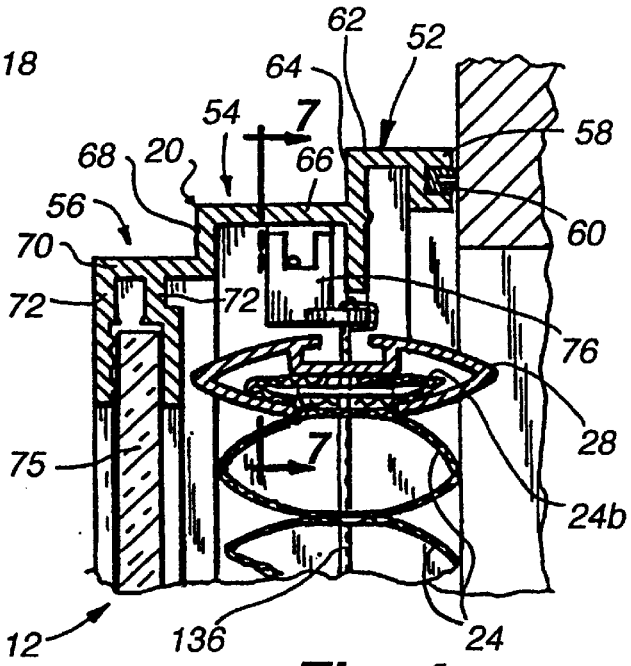
FIG. 4 is an enlarged fragmentary section taken along line 4—4 of FIG. 2.
Figure 5:
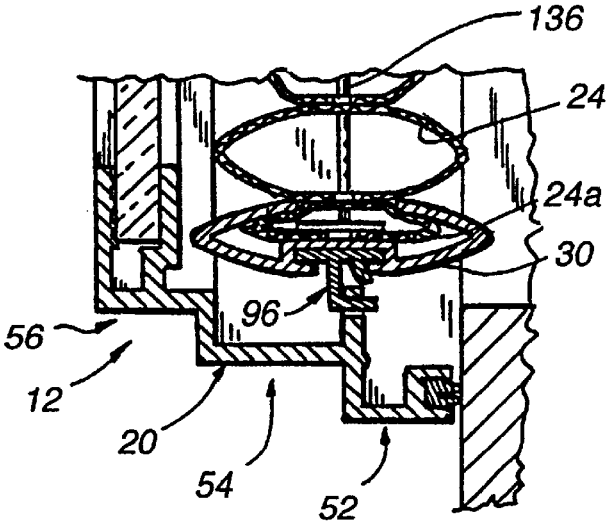
FIG. 5 is an enlarged fragmentary section taken along line 5—5 of FIG. 2.
Figure 6:
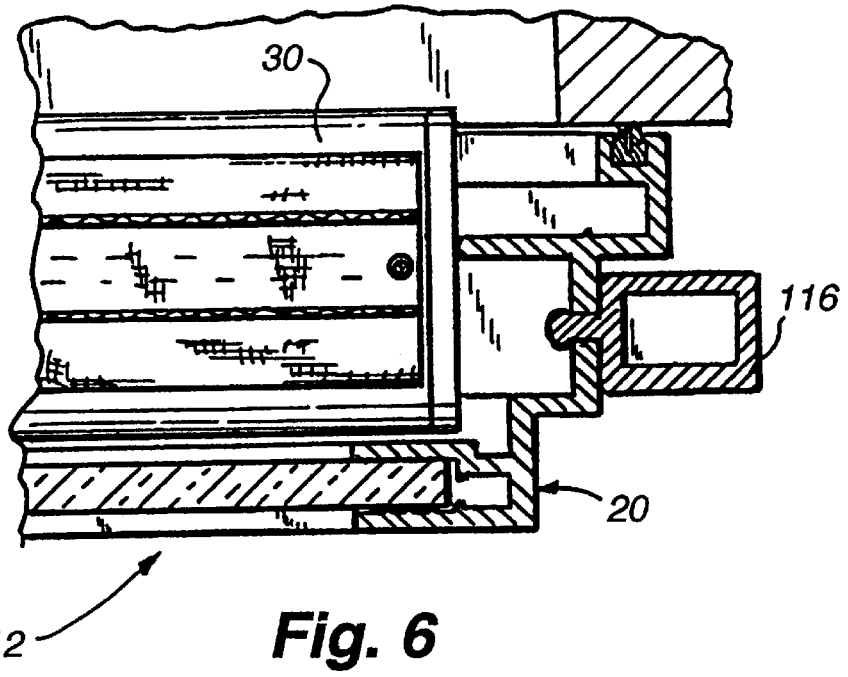
FIG. 6 is an enlarged fragmentary section taken along line 6—6 of FIG. 2.
Figure 7:
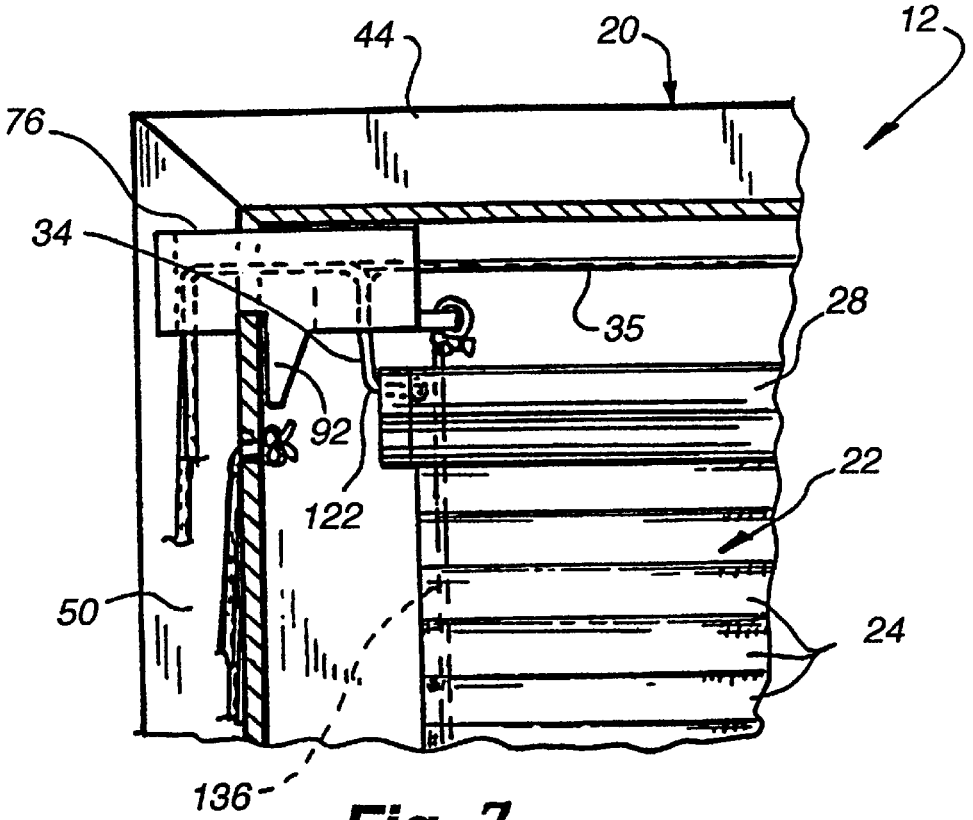
FIG. 7 is an enlarged fragmentary section taken along line 7—7 of FIG. 4.

As best seen in FIG. 11 but further supported in FIGS. 4, 5, and 7, a pair of alignment or guide cords 136 cooperate with the collapsible shade 22 to prevent it from swinging within the framework 20 so that the shade always remains parallel with the framework. The alignment cords extend vertically within the frame having their upper ends secured to the attachment arm 86 of an associated clip 72 as by knotting the cord after it has been extended through the aperture 88 in the attachment arm. The lower end of each alignment cord 136 is secured to the bottom rail 30 of the collapsible shade as by extending through an opening 138 provided therein and knotting the lower end within the bottom rail. Each cell in the collapsible shade is also provided with aligned apertures 140 through which the alignment cords extend so that the entire shade is confined by the alignment cords and assuring that the movement of the top rail is guided in its movement between the open and closed positions of the shade. The alignment cords 136 not only guide the movement of the covering between its open and closed positions, but also confine the covering so that it remains in substantially parallel relationship with the surrounding frame. The covering is, therefore, not allowed to move or rattle within the frame when the door 14 or other structural member on which the frame is mounted is moved.

It will be appreciated from the above description that a framed covering for an architectural opening is provided such that the covering can be moved between open and closed positions and confined to remain in parallel relationship with the structural member on which it is mounted so as not to be an annoyance to an individual who moves the structural member, as would otherwise be the case if the covering were not so confined. It is also easily movable between its open and closed positions with a simplified and dependable control system so that vision and light can be selectively permitted through the architectural opening. The framework for the covering further provides a means for protecting the covering from environmental elements such as dust and the like which might otherwise deteriorate the covering or detract from the aesthetics of the covering.

Figure 12:
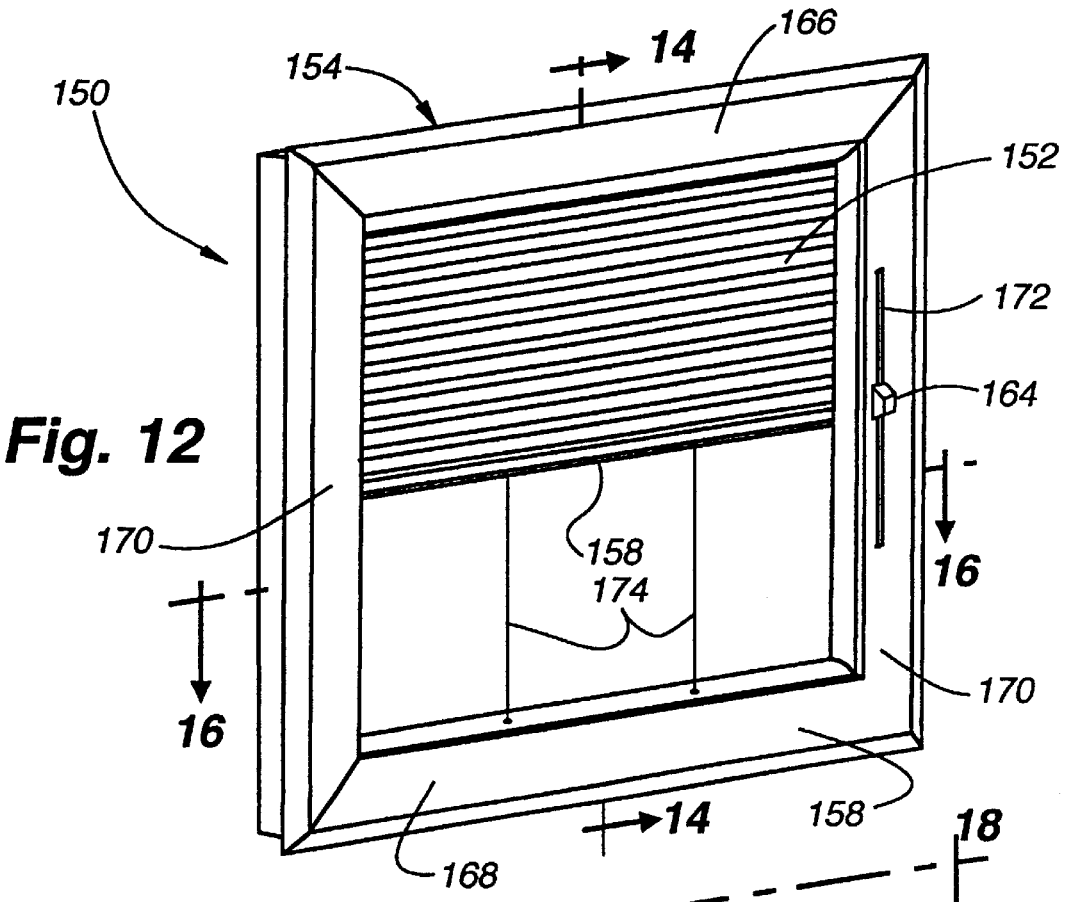
FIG. 12 is an isometric view looking at the front of a covering for an architectural opening in accordance with a second embodiment of the present invention.
Figure 65:
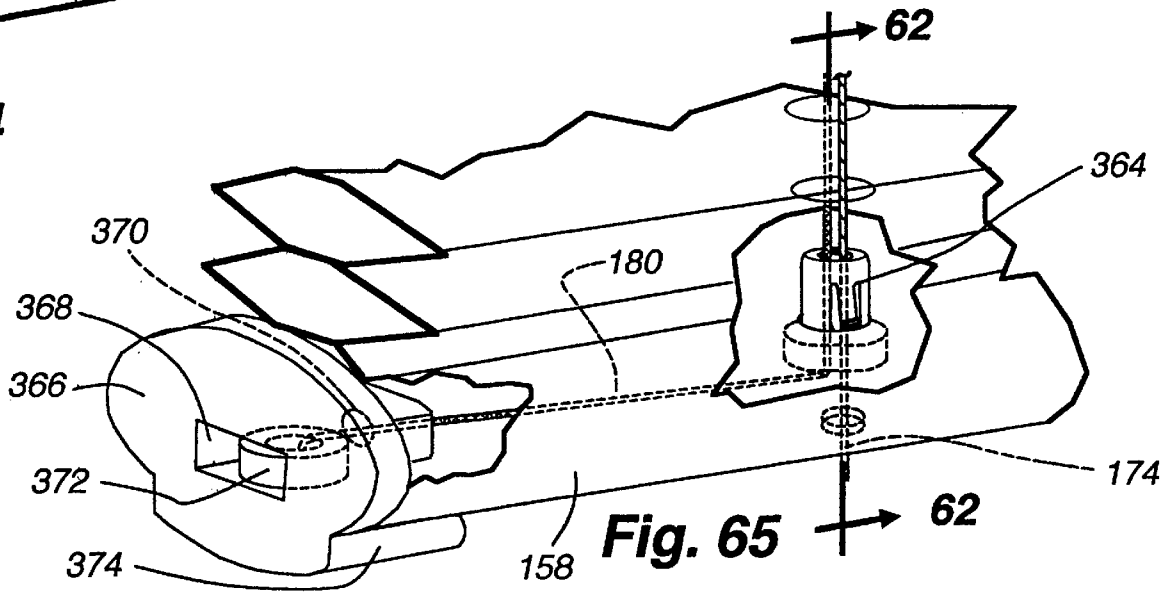
FIG. 65 is a fragmentary isometric with parts removed similar to FIG. 64 with the parts assembled.

Another embodiment 150 of the present invention is illustrated in FIGS. 12–65. In this embodiment of the invention, a collapsible shade or curtain 152 such as a cellular shade, pleated shade or the like, is mounted for movement in an outer frame 154 between extended and retracted positions across an architectural opening in which the frame is positioned. The movement of the covering is effected by movement of a slide member in the frame. The linear movement of the cellular shade, pleated shade or other curtain across the architectural opening occurs at a faster rate than the rate of movement of the slide member so that the slide member does not have to be moved very far to effect a total movement of the curtain. In other words and by way of example, if the slide member is moved an inch, the curtain is moved two inches during a retracting or extending motion so that the curtain can be made to extend completely across an architectural opening while linear movement of the slide member is only half or some other portion of that distance.

The covering includes the collapsible curtain 152 (which is illustrated in the form of a cellular curtain), a bottom rail 158 secured to the lower edge of the curtain, and an operating system including a cord operating mechanism 160 and a transfer mechanism 162 effective in converting movement of the slide member into movement of the curtain across the architectural opening. The covering is preferably mounted in the frame that is adapted to be inserted into an existing architectural opening which may already be framed and the frame 154 for the covering is designed to conceal the operating components with the exception of the slide member which in the preferred embodiment is in the form of a finger slide 164 readily accessible to an operator of the covering. The cord operating mechanism 160 for the covering utilizes pull or lift cords for moving the covering between extended and retracted positions and in one embodiment at least one guide cord for guiding movement of the covering which would render the covering desirable for moveable architectural openings such as in a door, moving partition or the like.

Figures 14, 15, 16:
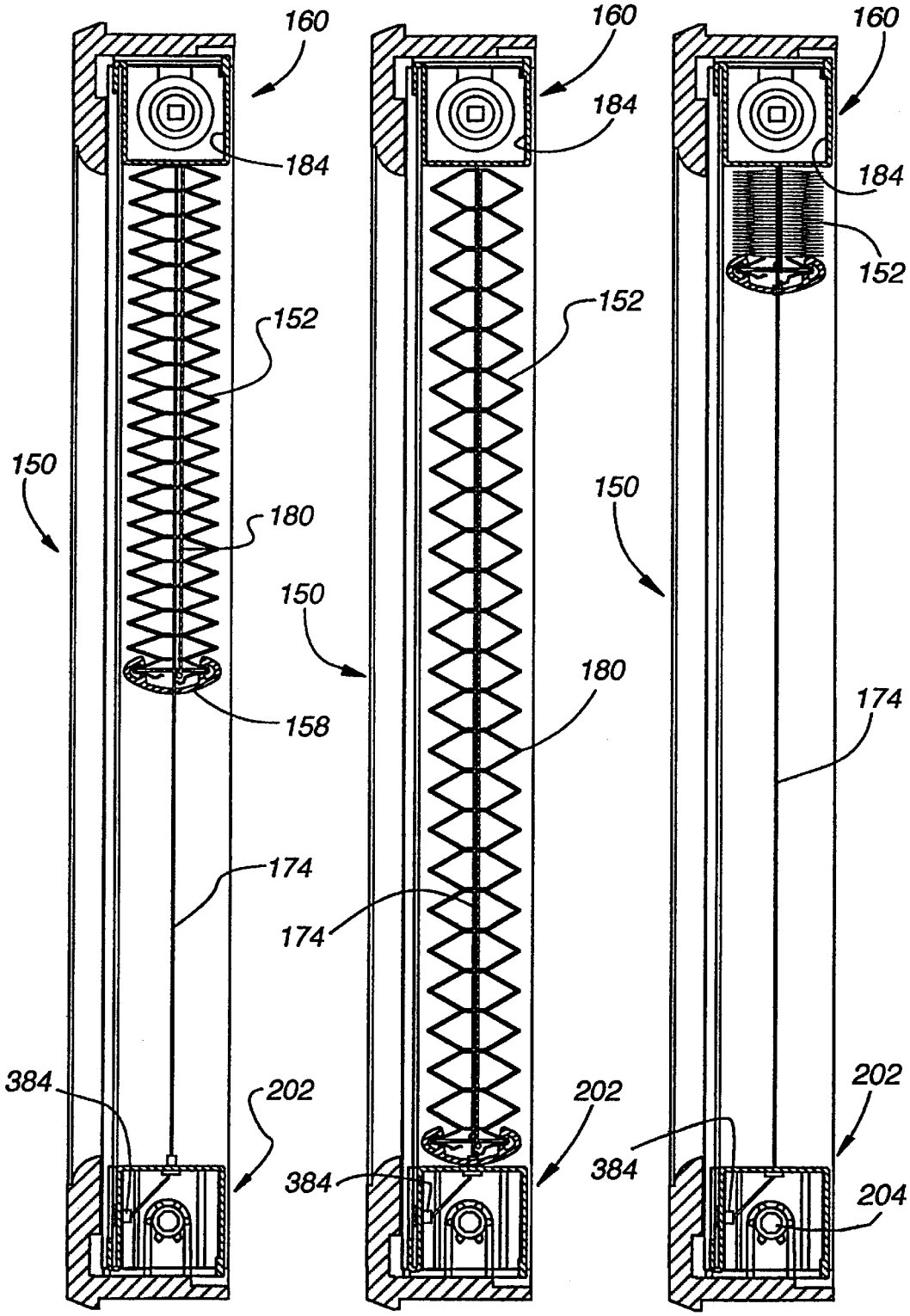
FIG. 14 is an enlarged section taken along line 14—14 of FIG. 12.
FIG. 15 is a section similar to FIG. 14 showing the curtain for the covering in a fully extended position.
FIG. 16 is a section similar to FIG. 14 showing the curtain in a fully retracted position.
Figure 17:
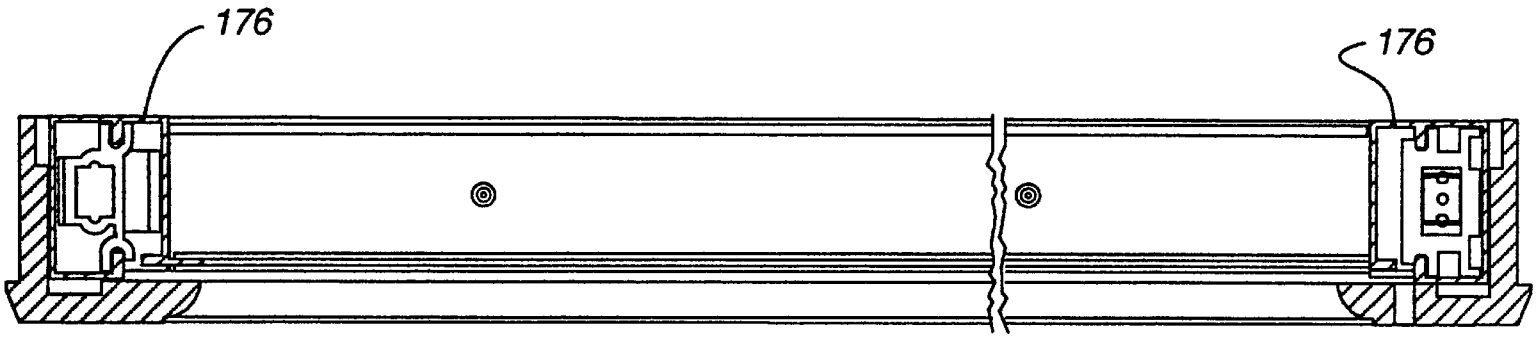
FIG. 17 is an enlarged fragmentary section taken along line 17—17 of FIG. 12.
Figure 18:
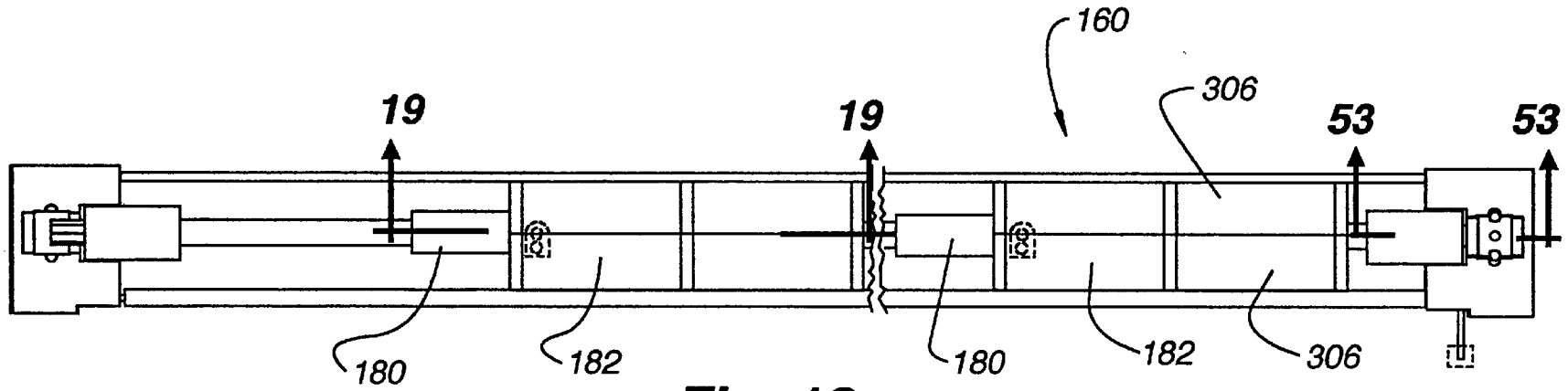
FIG. 18 is an enlarged fragmentary section taken along line 18—18 of FIG. 13.

With reference first to FIG. 12, the outer peripheral frame can be seen to include top 166 and bottom frame 168 members as well as side frame members 170. A vertical slot 172 is provided in the right side frame member to receive the finger slide 164 which is used to operate the covering and as will be appreciated with the description that follows, in one preferred embodiment thereof, movement of the finger slide causes a corresponding movement of the shade of twice the linear distance of the finger slide. Other ratios can be obtained by varying the dimensions of various component parts of the covering as will be readily understood by those skilled in the art with the description that follows. With reference to FIGS. 14–16, the covering 150 is shown in various positions across the architectural opening with FIG. 14 showing the covering partially extended, FIG. 15 fully extended, and FIG. 16 fully retracted. Guide cords 174 are also seen in FIGS. 14–16 for guiding vertical movement of the curtain in a manner that will become more clear later.

Figure 13:
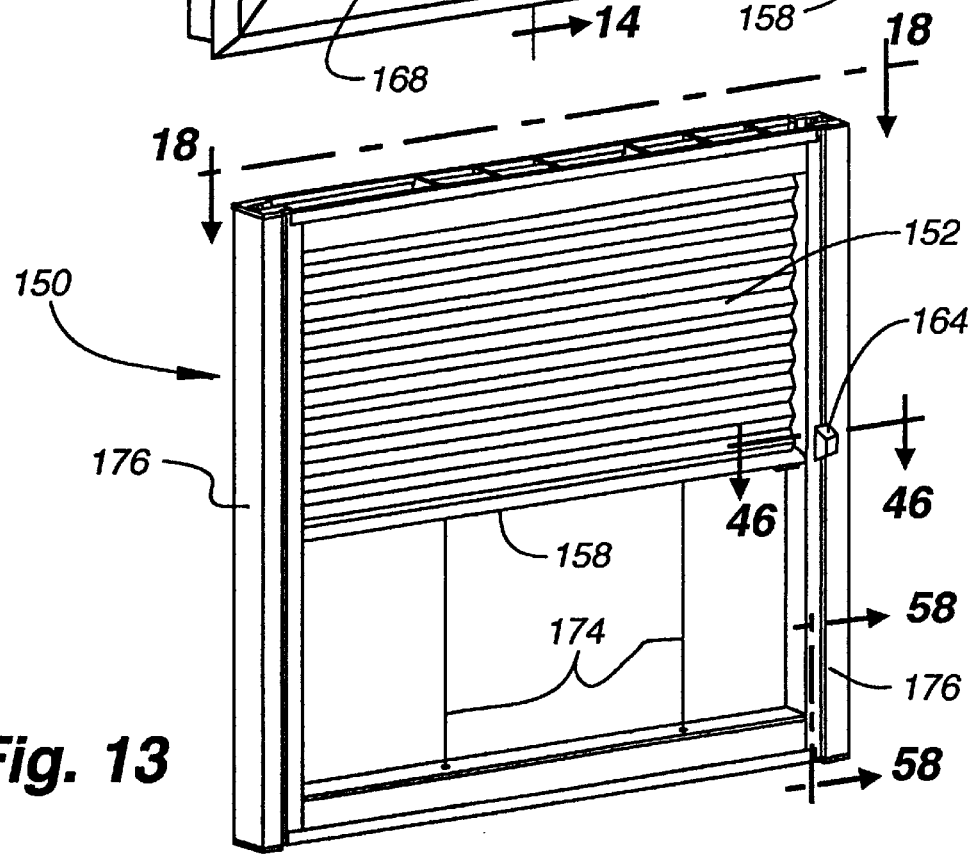
FIG. 13 is an isometric view of the covering shown in FIG. 12 with the outer frame for the covering having been removed.
Figure 13A:
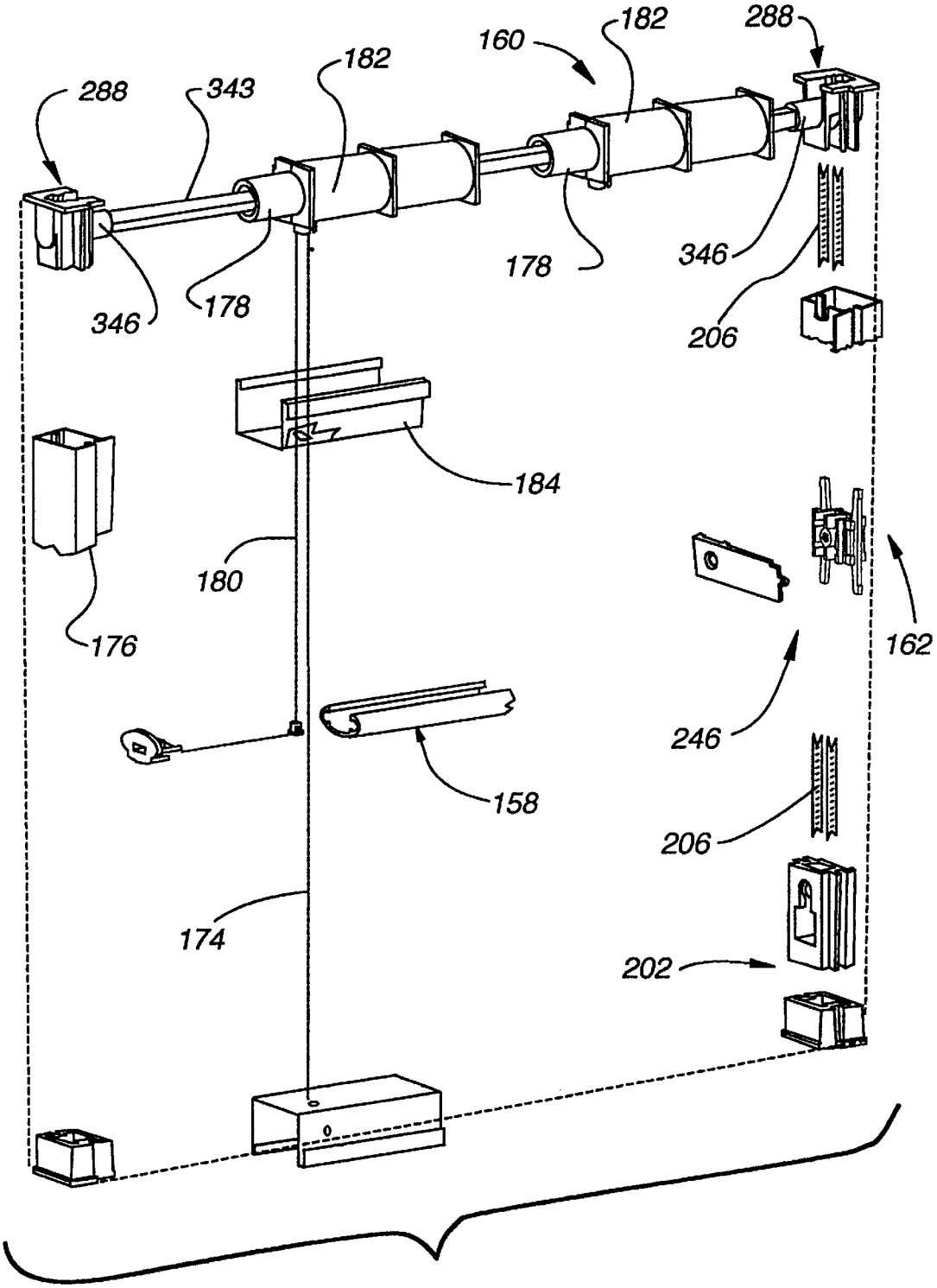
FIG. 13A is an isometric view of the operating system for the covering of FIG. 12 with some parts removed.
Figure 43:
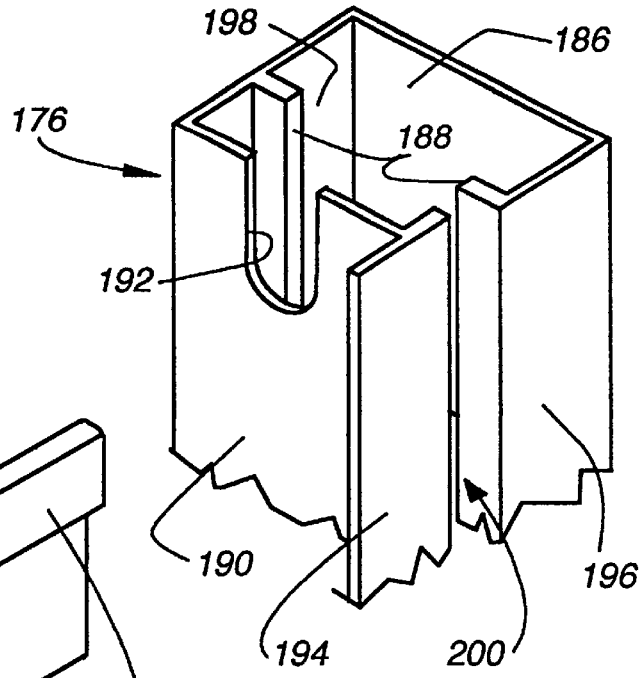
FIG. 43 is a fragmentary isometric looking at the top end of the channel guide for the transfer system used in the covering of FIG. 12.

With reference to FIGS. 13, 13A and 43, the operating or control system for the covering includes identical vertically extending channel guides 176 in the left and right vertical side frame members 170 with the channel guide in the right frame member housing the transfer mechanism 162 adapted to transfer movement of the finger slide 164 to the lift system or cord operating mechanism 160 that extends across the frame within the top frame member 166. The lift system includes a plurality of cord spools 178 each having one end of a lift cord 180 secured thereto with the other end of the lift cord passing downwardly through the curtain 152 so as to be anchored at its opposite end to a bottom rail 158 of the covering. The lift cord is adapted to be wound about the cord spool as the bottom rail is lifted. Rotative movement of the spool is effected by sliding movement of the finger slide in a manner to be described hereafter. The cord spools are confined in outer housings 182 that are positioned within a supporting channel 184 across the top of the architectural opening with the supporting channel being supported at opposite ends by the vertically extending channel guides at opposite sides of the frame. The supporting channel houses the cord operating mechanism 160 and the channel guides house the transfer mechanism 162. The transfer mechanism transfers linear movement of the finger slide and converts it to rotative motion for operating the cord operating mechanism.

The channel guides 176 are identical with one being illustrated in FIG. 43 to be substantially quadrangular in cross section having an outer wall 186, a pair of inturned lips 188, an inner wall 190 with a U-shaped notch 192 formed at the top thereof, and a flange 194 across the front edge of the inner wall which is aligned with a front wall 196 of the channel. A rear wall 198 of the channel is continuous between the outer and inner walls. A slot 200 is defined between the outer wall 186 and the flange 194 for guiding movement of the finger slide 164 in a manner to be described later.

Figure 40:
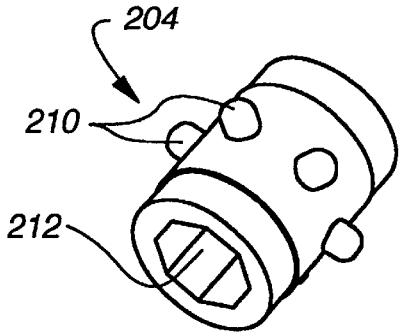
FIG. 40 is an isometric view of the timing roller used in the belt transfer system for operating the cord operating mechanism for the covering of FIG. 12.
Figure 48:
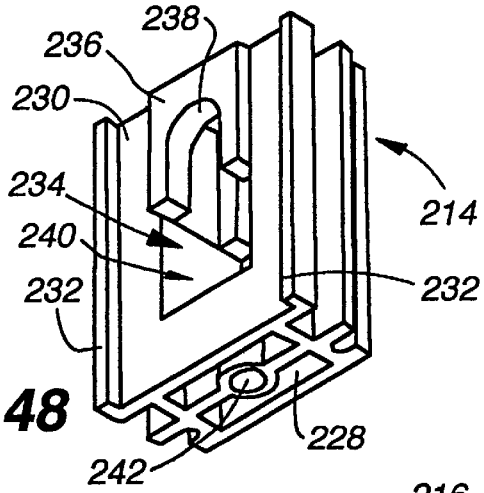
FIG. 48 is an isometric view of the main component of the bottom bracket used in the transfer system for the covering of FIG. 12.
Figure 50:
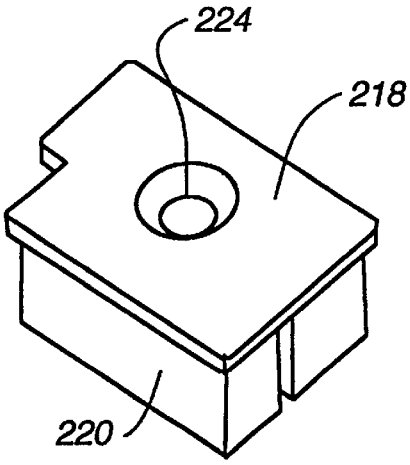
FIG. 50 is an isometric view looking upwardly at the bottom of the closure cap shown in FIG. 49.
Figure 49:
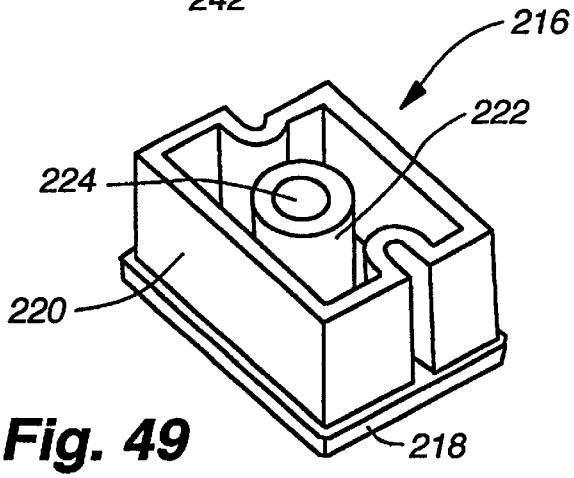
FIG. 49 is an isometric view looking downwardly on the closure cap portion of the bottom bracket for the covering shown in FIG. 12.
Figure 58:
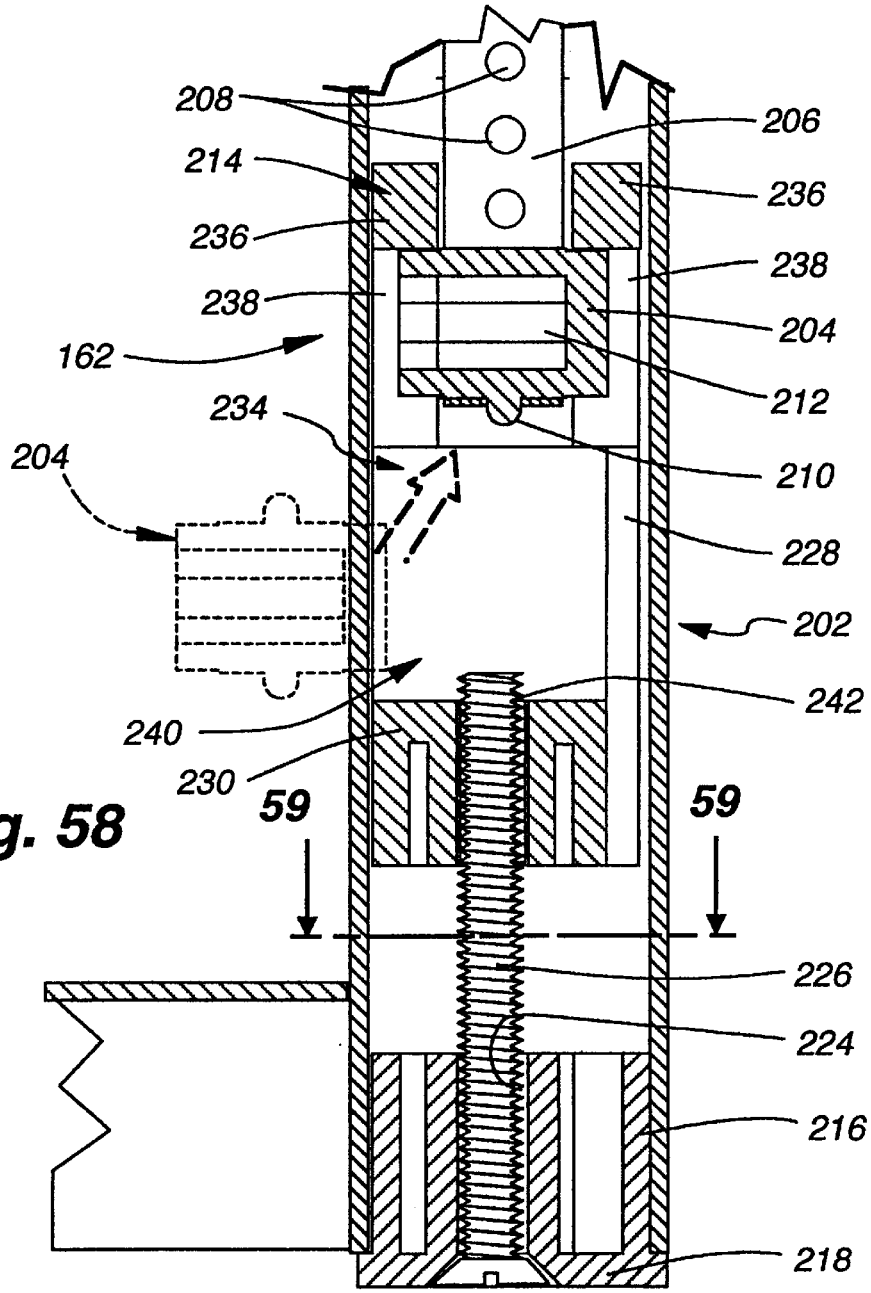
FIG. 58 is an enlarged fragmentary section taken along line 58—58 of FIG. 13.
Figure 59:
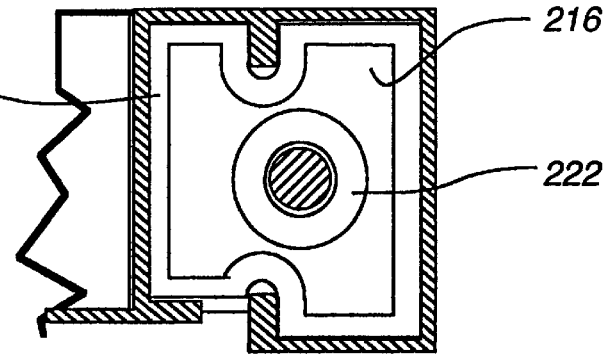
FIG. 59 is a fragmentary section taken along line 59—59 of FIG. 58.

A bottom bracket 202 shown best in FIGS. 48–50, 58 and 59, is a two-piece adjustable bracket for supporting a lower timing roller 204 which rotatably supports the lower most end of an endless timing belt 206. The timing belt, which is best seen in FIGS. 13A, 14–16, 53 and 55, is a flat, flexible but non-extensible belt having a plurality of spaced apertures 208 along its length. The apertures are adapted to cooperate with beads 210 (FIG. 58), distributed circumferentially around the perimeter of the timing roller. The timing roller which is best illustrated in FIG. 40 is a cylindrical roller having the beads around its periphery and an octagonal blind hole 212 formed axially therein. The bottom bracket includes a main body 214 and a closure or bottom cap 216 with the main body and closure cap being interconnected for vertical adjustment relative to each other. The closure cap 216 as seen in FIGS. 49 and 50 has a base plate 218 and an upstanding peripheral wall 220 that substantially conforms with and is of slightly smaller dimension than the cross section of the channel guide 176. Accordingly, the closure cap is adapted to be inserted into the open bottom end of an associated channel guide and is frictionally retained therein as illustrated in FIG. 59. The closure cap has a cylindrical hub 222 passing vertically therethrough with an axial passageway 224 of a predetermined dimension. The axial passageway is designed to slideably receive a connector bolt 226 which is used to adjustably connect the closure cap 216 with the main body 214 of the bottom bracket as shown best in FIG. 58.

The main body 214 of the bottom bracket as best seen in FIG. 48, has an outer plate 228 adapted to abut the inner surface of the outer wall 186 of the channel guide and an inner plate 230 with inwardly directed vertically extending legs 232 adapted to engage the inturned lips 188 of the channel guide so that the main body of the bottom bracket can be positively positioned within the channel guide but be slidably movable longitudinally thereof. The main body further includes a pocket 234 defined between a pair of walls 236 having inverted U-shaped notches 238 formed therein that are adapted to rotatably receive opposite ends of the timing roller 204. The inverted U-shaped notches are spaced upwardly from an opening 240 through the inner plate 230 of the main body so that the roller can be inserted into the lower portion through the opening 240 and moved upwardly into the U-shaped notches 238 as illustrated in FIG. 58 to properly position the timing roller in the main body.

As also seen in FIG. 58, the main body 214 has a threaded vertically extending passage 242 therein that extends through a lower portion of the main body and opens into the pocket 234. The threaded passage is adapted to threadedly receive the top of the connector bolt 226 so that rotative movement of the bolt causes the main body to be moved upwardly or downwardly relative to the closure cap. As the timing roller is inserted into the pocket, it is positioned within the lower end of the endless timing belt 206 so that the beads around the periphery of the timing roller engage corresponding holes in the timing belt. As mentioned previously, the timing belt passes around an identical timing roller 244 at the top of the channel guide 176 and the tension in the belt can be regulated by adjusting the position of the main body of the lower bracket relative to the closure cap with the connector bolt.

Figure 45:
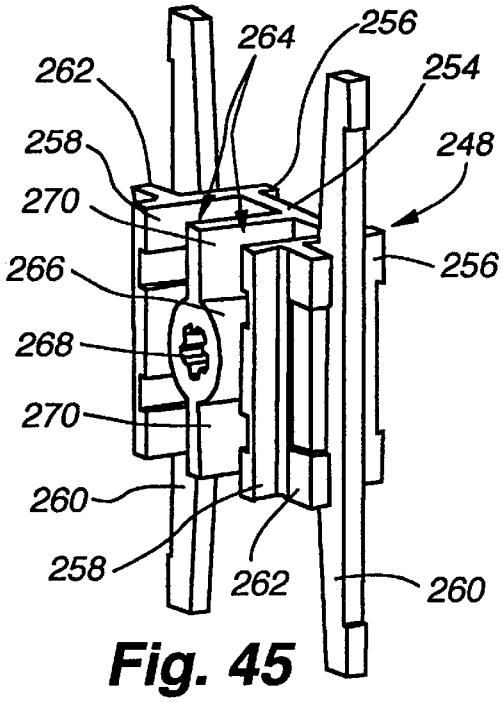
FIG. 45 is an isometric view of the base component of a slide bracket used in the transfer system for the covering shown in FIG. 12.

The finger slide 164 is part of a slide bracket 246 that is secured to the timing belt 206 at an intermediate location along one of the vertical runs of the timing belt and in alignment with the slot 172 in the right frame member. The slide bracket is a three piece bracket with the components thereof best illustrated in FIGS. 45–47, 56 and 57. A main body 248 of the slide bracket is shown in FIG. 45, an inner closure plate 250 in FIG. 47 and an anchor block 252 in FIG. 46. The main body can be seen to include an outer plate 254 with outwardly directed vertically extending slide legs 256 protruding from front and rear edges thereof adapted to slidingly engage the inner surface of the outer wall 186 of the channel guide. A pair of side walls 258 project inwardly from the outer plate 254 and have slide arms 260 integrally formed thereon which extend vertically and are adapted to slidingly engage the front 196 and rear 198 walls of the channel guide. The slide arms are spaced from guide plates 262 that also project forwardly and rearwardly from the side walls. A vertically extending groove 264 is defined between the slide plates and the slide arms with the groove being adapted to receive the inturned lips 188 of the channel guide. A cylindrical hub 266 projects inwardly from the outer plate 254 of the main body and has a blind hole 268 therein as well as upwardly and downwardly extending vertical gussets 270. Vertical channels 264 are defined between the hub and the side walls of the main body through which the vertical runs of the timing belt are adapted to pass.

Figure 47:
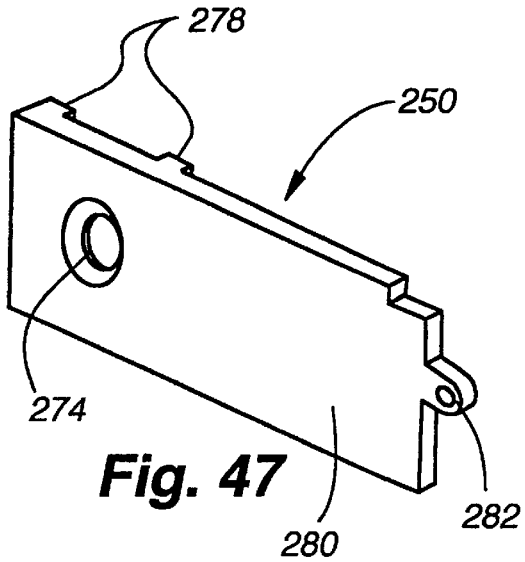
FIG. 47 is an isometric view of the closure plate component of the slide bracket.

The inner closure plate 250 shown in FIG. 47 is a substantially rectangular flat bar having a transverse opening 274 therethrough adapted to be aligned with the blind hole 268 in the main body so that a screw type fastener 276 can pass through the closure plate and into the blind hole to secure the main body to the closure plate. Vertical ribs 278 on the outer face of the bar are adapted to abut against the side walls 258 of the main body to assist in helping to retain the desired connected relationship between the main body and the closure plate. The closure plate has an extension portion 280 having a protruding tab 282 adapted to receive the finger slide 164 which is gripable by an operator of the covering. The finger slide is shown in dashed lines connected to the closure plate in FIG. 56.

Figure 46:
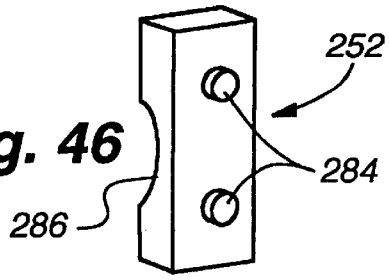
FIG. 46 is an isometric view of an anchor block used in the slide bracket.
Figure 56:
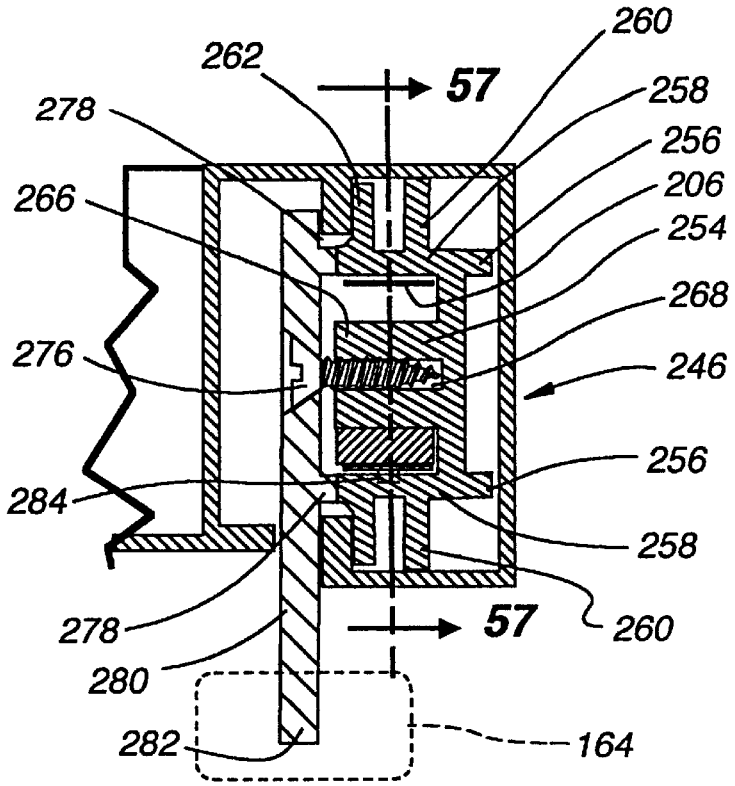
FIG. 56 is an enlarged fragmentary section taken along line 56—56 of FIG. 13.
Figure 57:
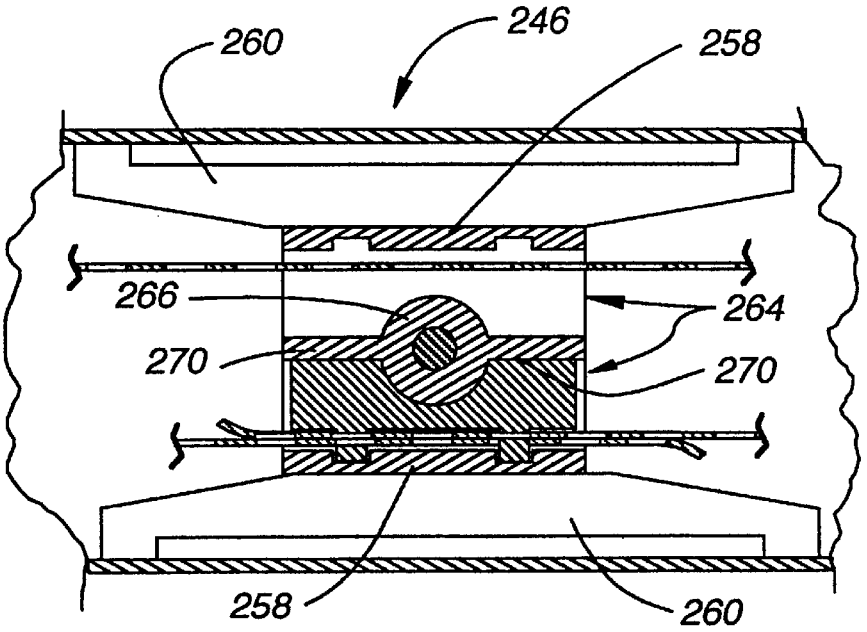
FIG. 57 is a fragmentary section taken along line 57—57 of FIG. 56.

The anchor block 252 is adapted to be positioned within one of the vertical channels 264 through the main body 248 and in alignment with the timing belt 206 to connect the timing belt to the slide bracket. As seen in FIG. 46, the anchor block has a pair of protruding pins 284 that are adapted to extend through corresponding openings in the timing belt and ultimately be received in corresponding recesses in the front side wall of the main body of the slide bracket as shown in FIG. 56. The reverse side of the anchor block has a semi-cylindrical groove 286 therein adapted to conform with the hub 266 on the main body to positively position the anchor block within the slide bracket. It will therefore be appreciated that when the slide bracket is assembled with its three component parts, it is fixed to the timing belt for unitary movement therewith and has the protruding tab 282 and finger slide 164 disposed exteriorly of the frame so that an operator of the covering can linearly move the slide bracket along with the endless timing belt to operate the covering in a manner that will become more clear later.

Figure 51:
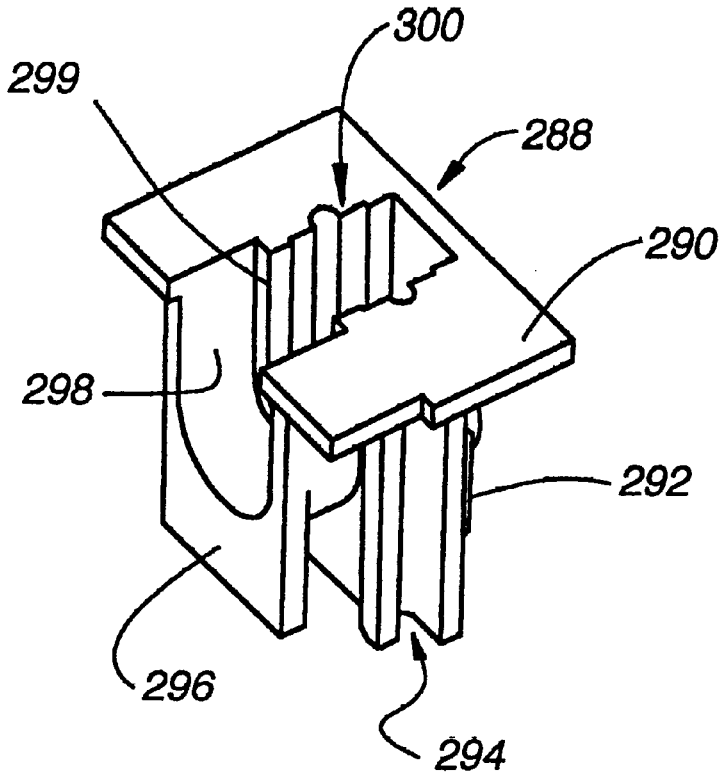
FIG. 51 is an isometric view looking downwardly on the upper bracket for the transfer system used in the covering of FIG. 12.
Figure 52:
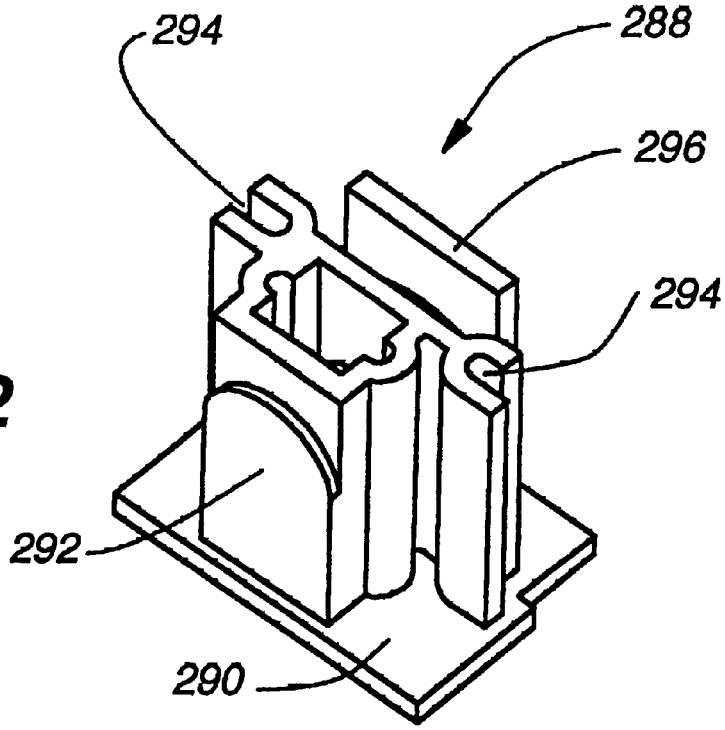
FIG. 52 is an isometric view looking upwardly at the bottom of the bracket shown in FIG. 51.
Figure 53:
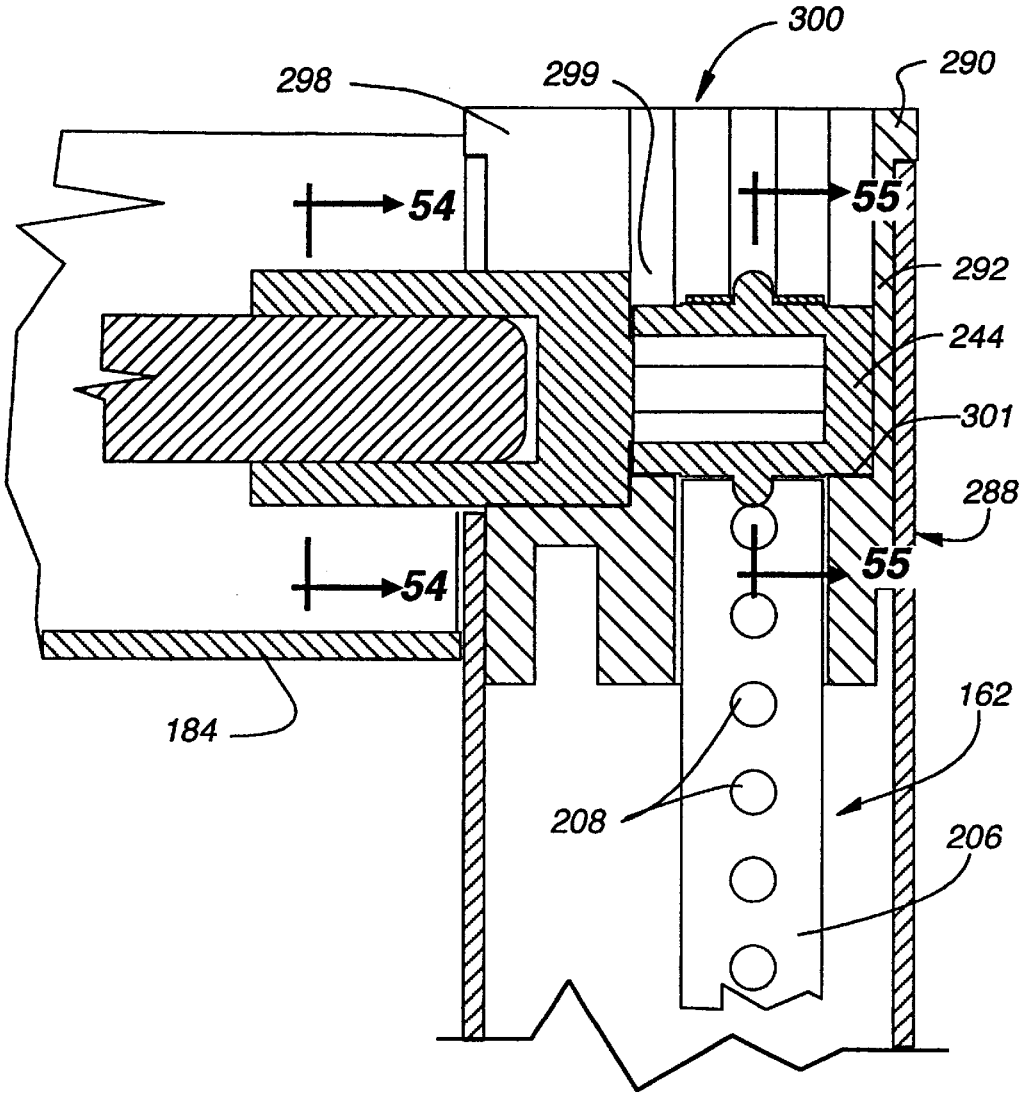
FIG. 53 is an enlarged fragmentary section taken along line 53—53 of FIG. 18.
Figure 54:
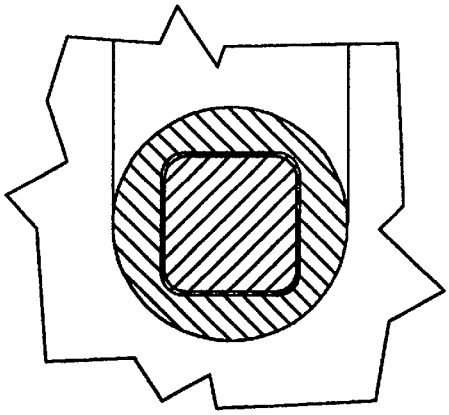
FIG. 54 is a fragmentary section taken along line 54—54 of FIG. 53.
Figure 55:
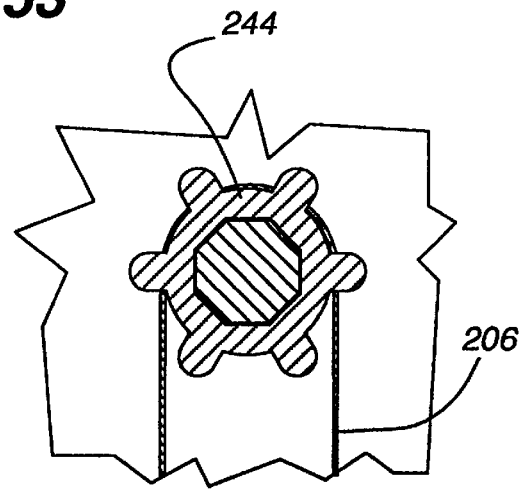
FIG. 55 is a fragmentary section taken along line 55—55 of FIG. 53.

The upper end of the channel guides 176 receive a top bracket 288 adapted to rotatably seat the upper timing roller 244 that confines the upper end of the endless belt. The upper bracket is shown in FIGS. 51–53 to include a top plate 290 that overlies the top end of the associated channel guide, an outer plate 292 adapted to engage the inner surface of the outer wall 186 of the channel guide, a pair of forwardly and rearwardly directed grooves 294 adapted to receive the inturned lips 188 of the channel guide and an inner wall 296 having a U-shaped notch 298 with a reduced size portion 299 of the same U-shaped configuration formed therein. The reduced portion 299 is adapted to support one stub shaft of the timing roller 244. The opposite stub shaft of the timing roller is supported in another U-shaped notch 301 formed in the inner surface of the outer plate 292 as probably best seen in FIG. 53. A pocket 300 is thereby defined in the interior of the top bracket with U-shaped slots adapted to support opposite ends of the timing roller so that the timing belt can be passed around the roller and with the roller being rotatably supported to accommodate movement of the timing belt.

Figure 41:
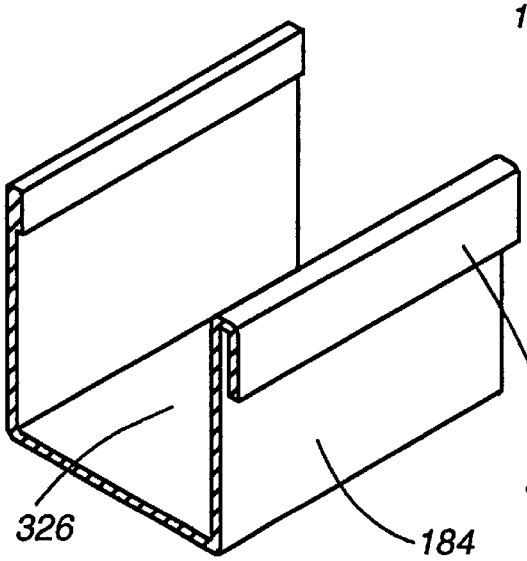
FIG. 41 is an isometric section taken through the channel support for the cord operating mechanism for the covering of FIG. 12.
Figure 42:
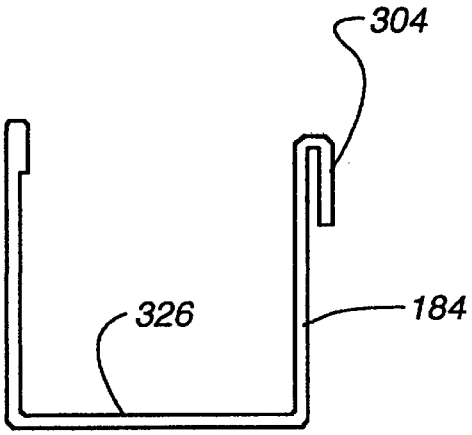
FIG. 42 is a left end elevation of the channel shown in FIG. 41.
Figure 44:
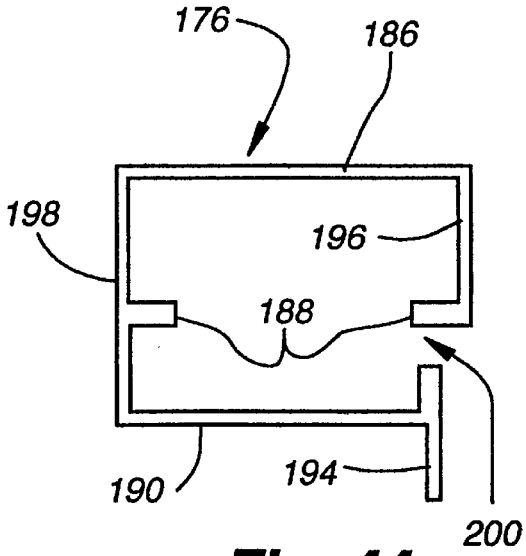
FIG. 44 is a top end elevation of the channel guide shown in FIG. 43.

It will therefore be seen that the transfer system disposed in the right side frame member converts sliding movement of the finger slide into rotative movement of the rollers 244 and 204 at the top and bottom respectively of the transfer system and rotative movement of the roller at the top of the system is utilized to rotate the cord spools 178 as will be described hereafter. The cord spools, shown in FIGS. 29–35, are rotatably supported in a two-piece housing 302 shown in FIGS. 24–28 with the housing being supported in the U-shaped support channel 184 illustrated in FIGS. 41, 42 and 44 that extends horizontally across the top of the frame 154 and within the confines of the top frame member 166. The U-shaped channel has a downturned lip 304 along its front side edge which is supported on the flange 194 of the channel guides at opposite sides of the frame so that the U-shaped channel opens upwardly to receive and support the housing.

Figures 23, 24, 25, 26, 27, 28:
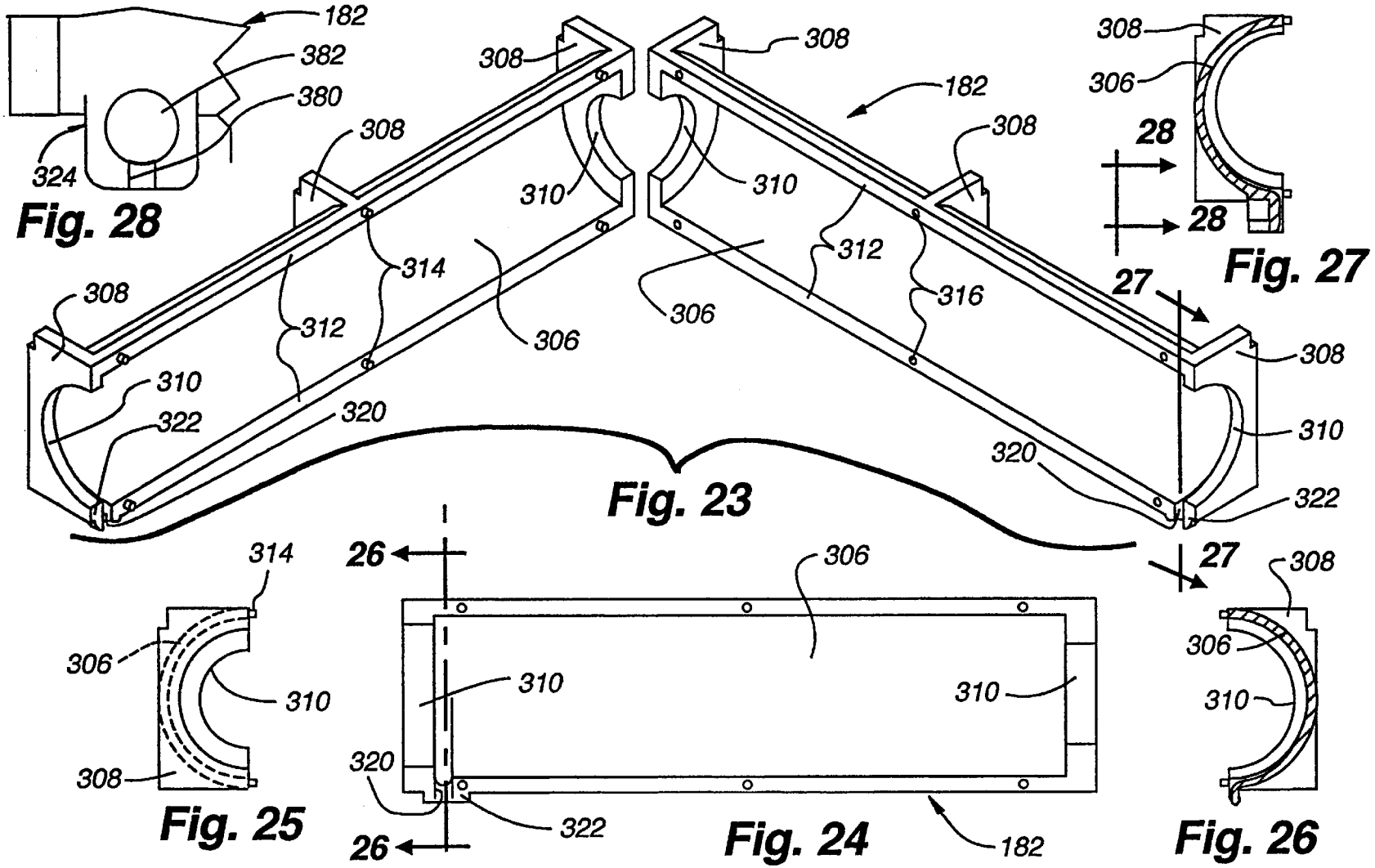
FIG. 23 is an exploded isometric view showing the housing for the cord operating mechanism used in the covering of FIG. 12.
FIG. 24 is a front view of one side of the two-piece housing shown in FIG. 23.
FIG. 25 is a left end elevation of the housing segment shown in FIG. 24.
FIG. 26 is a section taken along line 26—26 of FIG. 24.
FIG. 27 is a section taken along line 27—27 of FIG. 23.
FIG. 28 is a view taken along line 28—28 of FIG. 27.

The housing 302 probably best shown in FIG. 23, is a two-piece housing with the two components being substantially mirror images of each other. Each housing component has an elongated semi-cylindrical side wall 306 and substantially rectangular gussets 308 at opposite ends and at an intermediate location along the length of the side wall. The gussets have semi-circular notches 310 formed therein in alignment with and to receive the semi-cylindrical walls. Top and bottom confronting faces 312 are defined along the top and bottom edges of the side wall with the top and bottom faces on one component having a plurality of projecting pins 314 and the top and bottom confronting faces on the other component having complimentary cylindrical recesses 316 adapted to frictionally receive the pins 314 to releasably secure the components of the housing together. The rectangular gussets form a larger quadrangular gusset when the housing components are connected together with the quadrangular gussets conforming in size and dimension to the cross section of the support channel 184 in which the housing is positioned. Accordingly, the support channel assists in holding the housing components together and also positively positions the housing relative to the channel.

Figures 19, 20, 20A, 21, 22:
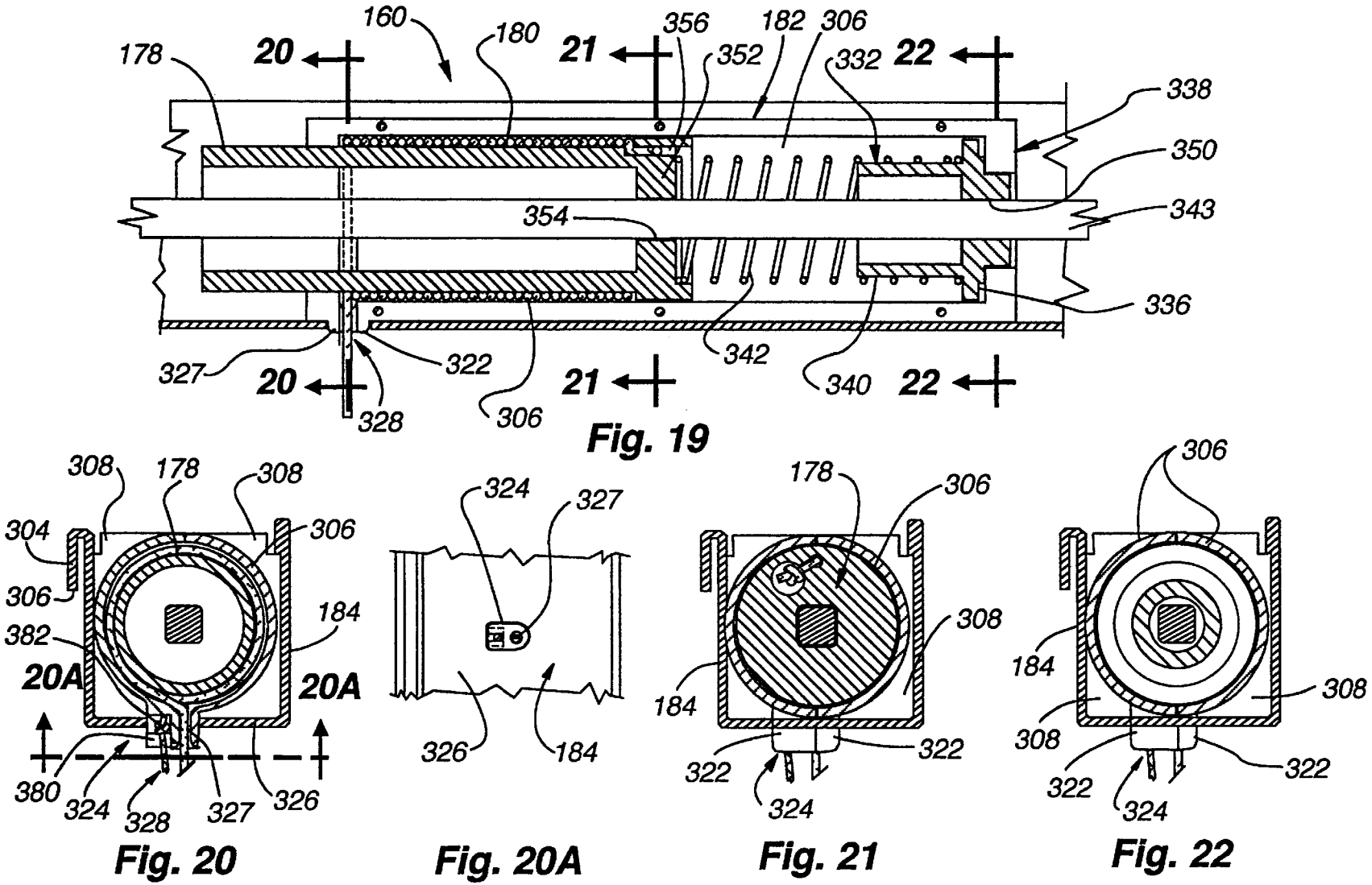
FIG. 19 is a fragmentary section taken along line 19—19 of FIG. 18.
FIG. 20 is a section taken along line 20—20 of FIG. 19.
FIG. 20A is a section taken along line 20A—20A of FIG. 20.
FIG. 21 is a section taken along line 21—21 of FIG. 19.
FIG. 22 is a section taken along line 22—22 of FIG. 19.

At one end of each housing component, a notch 320 is provided along the lower edge thereof immediately inwardly of the end gusset and a protrusion 322 extends downwardly from the housing. The protrusions on each component cooperate in defining a downward extension 324 from the housing adapted to be received in a complimentary opening 327 through the bottom wall 326 of the support channel 184 (FIGS. 20 and 20A). The downward extension thereby prevents the housing from sliding longitudinally of the channel and further provides a passage 328 through which guide and lift cords can be extended. It will also be appreciated that circular open ends are defined at each end of the housing by the complementary notches 310 when the components are connected together.

Figure 37:
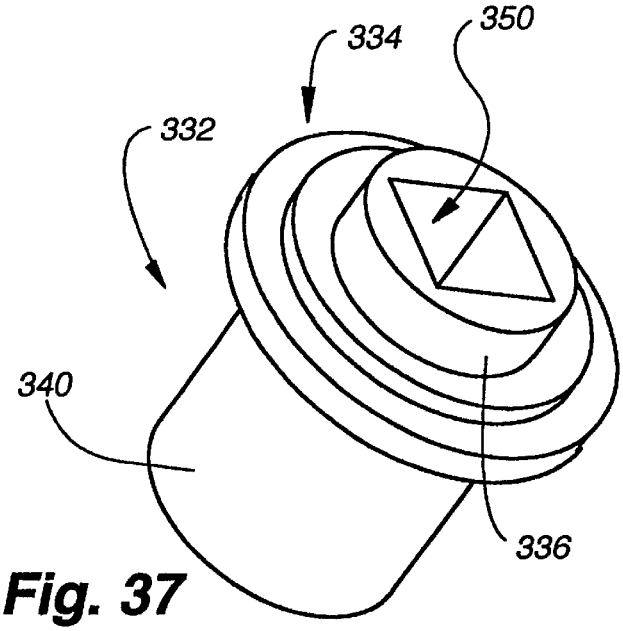
FIG. 37 is an isometric view of a sleeve adapted to be positioned within the housing of FIG. 23 to cooperate with the spool of FIG. 29 in the cord operating mechanism.

In order to lift collapsible shades in a uniform manner so that the bottom rail 158 always remains horizontal, it is desirable to have at least two lift cords 180 for lifting the bottom rail of the covering and a housing 302 is associated with each lift cord. In the disclosed embodiment, there are two lift cords and thus two housings positioned in the U-shaped support channel 184. With reference to FIGS. 19–22, it will be seen that the housing slideably supports a cord spool 178 therein with the spool projecting outwardly through the innermost open end of the housing. The housing illustrated in FIGS. 19–22 is at the right end of the U-shaped support channel 184 it being understood that a mirror image of the housing is disposed at the left end of the U-shaped channel. The circular opening at the right or outer end of the housing seats a cylindrical guide sleeve 332 (FIGS. 19 and 37) having a relatively thick head 334 adapted to be seated in the circular opening at the end of the housing. A back plate 336 on the head is adapted to internally engage the outermost end wall 338 of the housing, and an inwardly directed cylindrical support shaft 340 supports one end of a lightweight coil or compression spring 342 the opposite end of which is engaged with the adjacent end wall of the spool 178.

Figure 39:
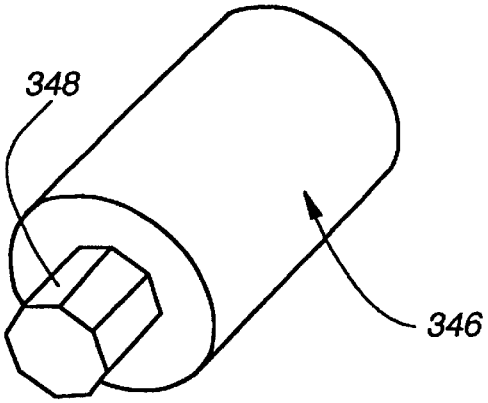
FIG. 39 is an isometric view looking at the opposite end of the coupler shown in FIG. 38.
Figure 38:
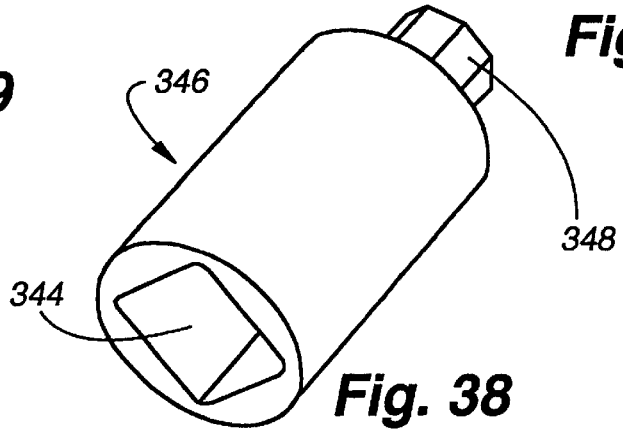
FIG. 38 is an isometric view of a coupler used in the cord operating mechanism of the covering shown in FIG. 12.
Figure 36:
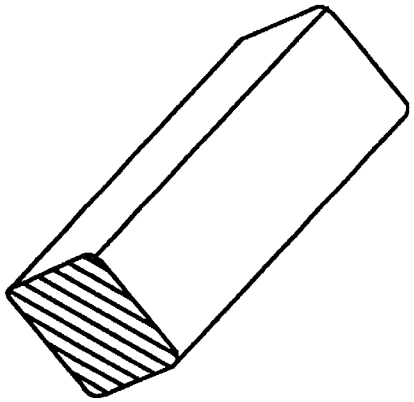
FIG. 36 is a fragmentary section showing an end portion of the square drive shaft used in the cord operating mechanism of the covering shown in FIG. 12.

A drive shaft 343 extends horizontally across the top of the frame 154 and is supported at opposite ends by the timing rollers 244 mounted at the upper ends of the channel guides 176 as described previously. The drive shaft is of square transverse cross section and has its opposite ends received in complimentary blind holes 344 provided in first ends of cylindrical coupler members 346 shown in FIGS. 38 and 39. The opposite ends of the cylindrical couplers have hexagonal stub shafts 348 adapted to be received in the octagonal blind hole of the associated timing roller so that rotation of the drive shaft across the top of the frame can be effected by rotational movement of the timing rollers which of course is effected by sliding movement of the finger slide 164. The timing roller in the right channel guide becomes a driven roller while the timing roller in the left channel guide is an idler roller as there is no timing belt in the left channel guide. In fact, the timing roller on the left channel guide can be omitted as the coupler can simply be supported in the U-shaped notch 298 of the top bracket in the left channel guide.

The guide sleeve 332 also has a square passage 350 therethrough that receives the drive shaft so that it too is rotated with the drive shaft. The outermost end of the cord spool 178 has a disk-like wall 352 having a square passage 354 therethrough that also mates with the drive shaft to effect unitary rotation of the spool with the drive shaft. As is best appreciated by reference to FIG. 19, the rotation of the drive shaft effects rotation of the guide sleeve 332 as well as the spool 178 and the spool is biased inwardly toward the center of the frame by the coil spring 342.

Figures 29, 30, 31, 32, 33, 34, 35:
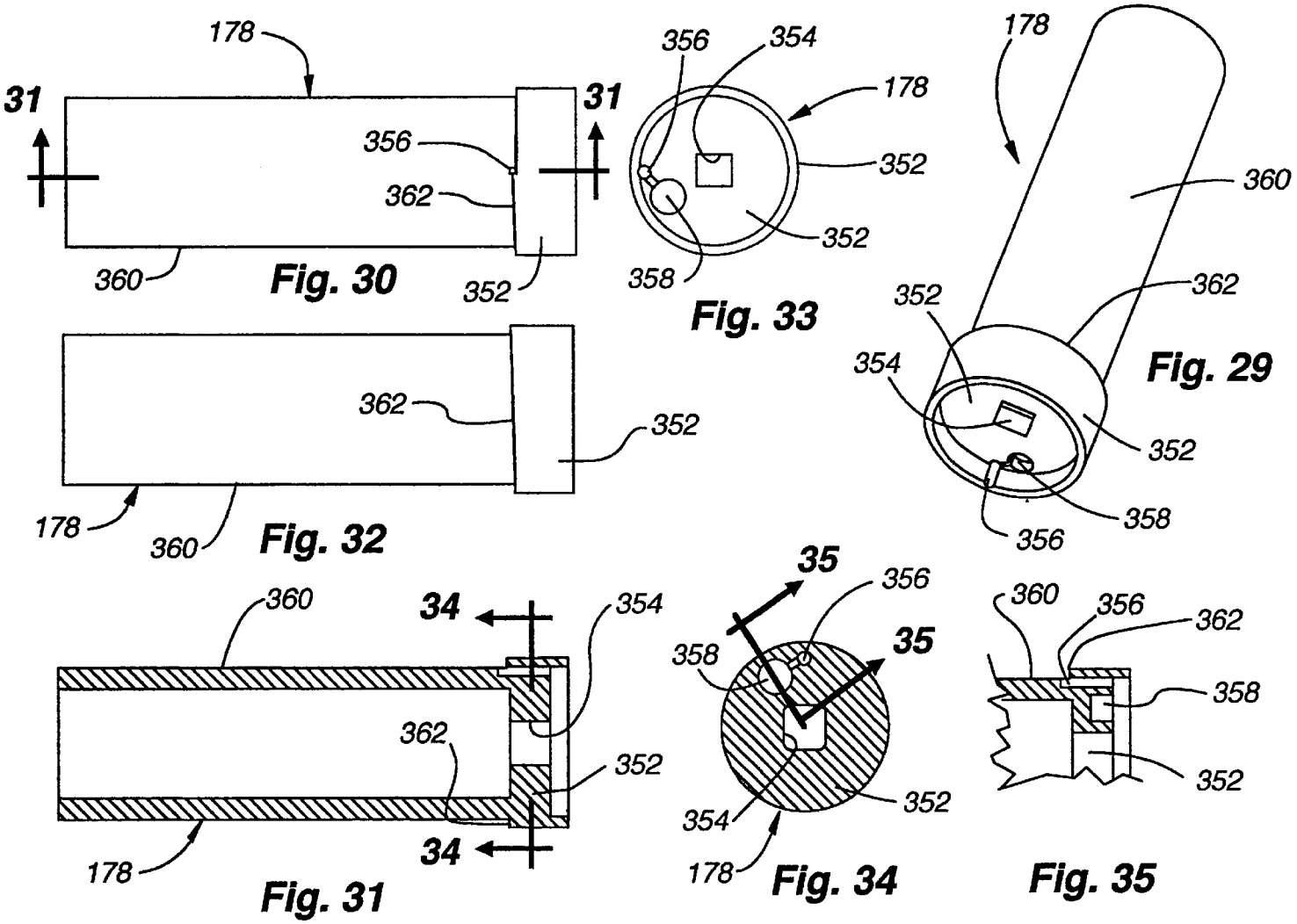
FIG. 29 is an isometric view of the cord spool used in the cord operating mechanism of the covering shown in FIG. 12.
FIG. 30 is a side elevation of the spool shown in FIG. 29.
FIG. 31 is a section taken along line 31—31 of FIG. 30.
FIG. 32 is a bottom plan view of the spool as shown in FIG. 30.
FIG. 33 is a right end elevation of the spool as shown in FIG. 30.
FIG. 34 is a section taken along line 34—34 of FIG. 31.
FIG. 35 is a fragmentary section taken along line 35—35 of FIG. 34.

The downward extension 324 through the bottom of the housing at the inner end thereof as mentioned previously defines a passage 328 for guide and lift cords utilized in the system. A lift cord 180 is associated with each cord spool 178 with one end being anchored to the spool in a manner shown in FIGS. 19, 21, 29 and 33–35. The one end of the lift cord is passed upwardly through the downward extension so as to enter the housing 302 in alignment with the cord spool and the cord is then passed to the outermost end of the spool where it is fed through a relatively small diameter axial passage 356 so as to extend out of the outermost cylindrical end 352 of the spool. A knot is then tied in the end of the lift cord and the knot is seated in a cylindrical recess 358 in the end wall of the spool so that the lift cord is secured to the outermost end of the spool and is in alignment with a cylindrical surface 360 of the main body of the spool about which the lift cord is to be wrapped. At the right end of the spool, as illustrated in FIGS. 19, 30 and 32, it will be appreciated that the main cylindrical body 360 of the spool is of slightly smaller diameter than the relatively large cylindrical end 352 of the spool with the difference in radius of the two cylindrical surfaces being approximately equal to the thickness of the lift cord. The edge 362 of the cylindrical end 352 of the spool, which is contiguous with the cylindrical main body 360 of the spool, is tapered slightly (FIGS. 30 and 32) so that the lift cord when it is wrapped around the main body of the spool is wrapped at a slight bias or angle relative to the transverse dimension of the spool. It will therefore be appreciated that as the cord is wrapped around the main body of the spool commencing at the relatively large cylindrical end 352 thereof, the cord initially engages the edge 362 of the cylindrical end which causes it to be wrapped at a diagonal and after completing one wrap, the cord begins engaging itself in subsequent adjacent wraps with each adjacent wrap also being at a diagonal.

The compression spring 342 is of a length and weight such that when the curtain 152 for the covering is fully extended so that the lift cord 180 is substantially fully unwound from the spool, the edge 362 of the relatively large cylindrical end of the spool is aligned with the passage 328 through the downward extension 324 from the housing. The lift cord extends downwardly through aligned openings (not seen) in the curtain and is anchored to the bottom rail 158 by extending the lower end of the lift cord through a grommet 364 (FIGS. 62–65) in the bottom rail and then transversely of the covering and longitudinally of the bottom rail to one end of the bottom rail where the cord is anchored to an end cap 366 for the bottom rail. The end cap, as best seen in FIG. 64, has a rectangular opening 368 in its outer face that communicates with a smaller circular opening 370 through an inner wall so that the lift cord can be passed outwardly through the smaller opening as well as the larger rectangular opening and be secured to an anchor disk 372 that is slightly smaller in size than the rectangular opening. After tying the lower end of the lift cord to the disk, the disk is inserted into the rectangular opening so as to be frictionally seated therein and with the lift cord then passing through the end cap along the longitudinal dimension of the bottom rail and upwardly through the grommet and the curtain before being received on the cord spool.

In the neutral position of the compression spring 342, as mentioned previously, the edge 362 of the relatively large cylindrical end 352 of the spool is vertically aligned with the lift cord 180 as it extends downwardly through the curtain. As the spool is rotated by moving the finger slide 164 vertically within the slot 172, the lift cord is wrapped around the main cylindrical body 360 of the spool and as mentioned previously each wrap is at a bias and each wrap either engages the edge 362 of the large cylindrical end or the previous wrap so as to force the spool to the right as seen in FIG. 19 against the bias of the compression spring. The compression spring has a very small bias so that it can be overcome by the cord as the cord engages previous wraps but the strength of the spring is such that when the shade is being extended across the architectural opening and the lift cord is being unwound from the spool, the spring will slide the spool to the left as shown in FIG. 19 keeping the endmost wrap of the lift cord in alignment with the downward projection through the bottom of the housing.

Referring again to FIGS. 62, 64 and 65, the bottom rail 158 can be seen to be an upwardly opening channel-shaped rail having open ends and wherein the end cap 366 has plate-like protrusions 374 adapted to be frictionally received in and below the open end of the rail to secure the end caps to the rail. The curtain 152 for the covering of the invention is secured in the bottom rail by extending a semi-rigid or rigid anchor strip 376 horizontally through the lowermost cell in the curtain and within the open channel of the bottom rail with the strip of course having a large enough dimension so that it cannot be released through the opening through the top of the channel-shaped bottom rail. The strip thereby confines the lowermost cell in the rail and the end cap closes the open end of the rail so that a finished look is achieved.

If guide cords are desired for maintaining the curtain 152 in an erect orientation, the guide cords 174 can be anchored at a top end within the downward extension 324 at the bottom of the housing which has a narrow slot 380 (FIG. 28) formed therein and a larger cavity 382 thereabove so that a knot can be formed in the upper end of the guide cord and positioned in the larger cavity with the guide cord extending downwardly through the notch. The guide cord would extend downwardly through the curtain in closely adjacent parallel relationship with the lift cord 180 and after passing through the grommet 364 in the anchor strip of the bottom rail, the cord would pass further downwardly below the bottom rail and into the bottom frame member 168 of the covering which also has a U-shaped support channel 184 identical to that described previously in the top frame member but wherein the channel opens downwardly instead of upwardly as seen in FIGS. 14–16. After passing into the downwardly opening channel the lower end of the guide cord can be anchored in a grommet 384 (FIGS. 14–16) in the side wall of the support channel by again tying a knot in the end of the cord to secure the lower end in the grommet.

It will be appreciated from the above that a collapsible covering for an architectural opening has been described which is cord operated and easily moveable between extended and retracted positions by a finger slide. By varying the diameter of the timing roller 344 relative to the main cylindrical body 360 of the spool 178, the ratio of linear movement of the finger slide 164 relative to linear movement of the bottom rail 158 across the architectural opening can be regulated. In the described embodiment, that ratio is two to one so that a window that was three feet in height, for example, could be covered with the curtain through movement of the finger slide a distance of a foot and a half.

Figure 60:
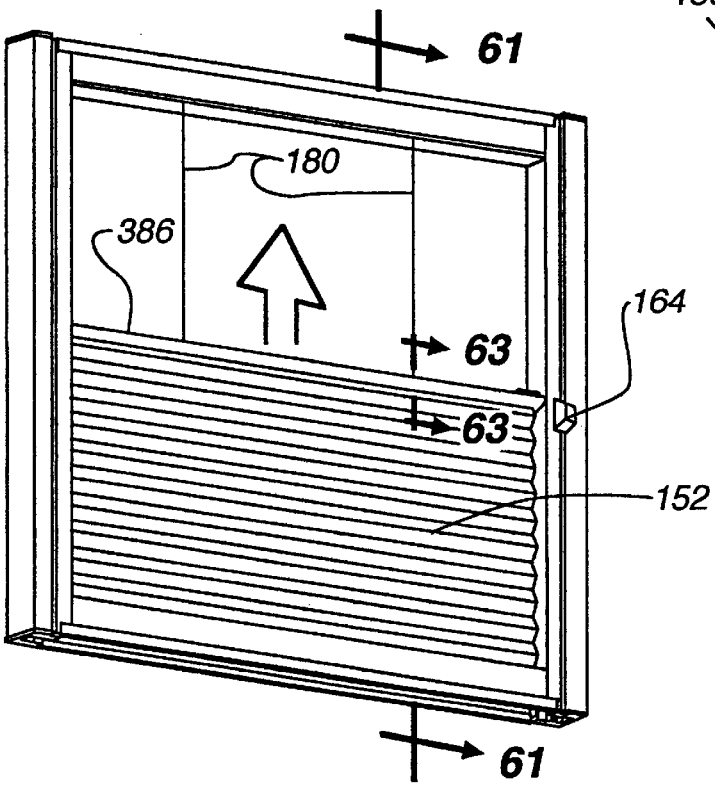
FIG. 60 is an isometric view of another embodiment of the covering as shown in FIG. 13 wherein the curtain component extends upwardly across the opening rather than downwardly as in FIG. 13.
Figure 61:
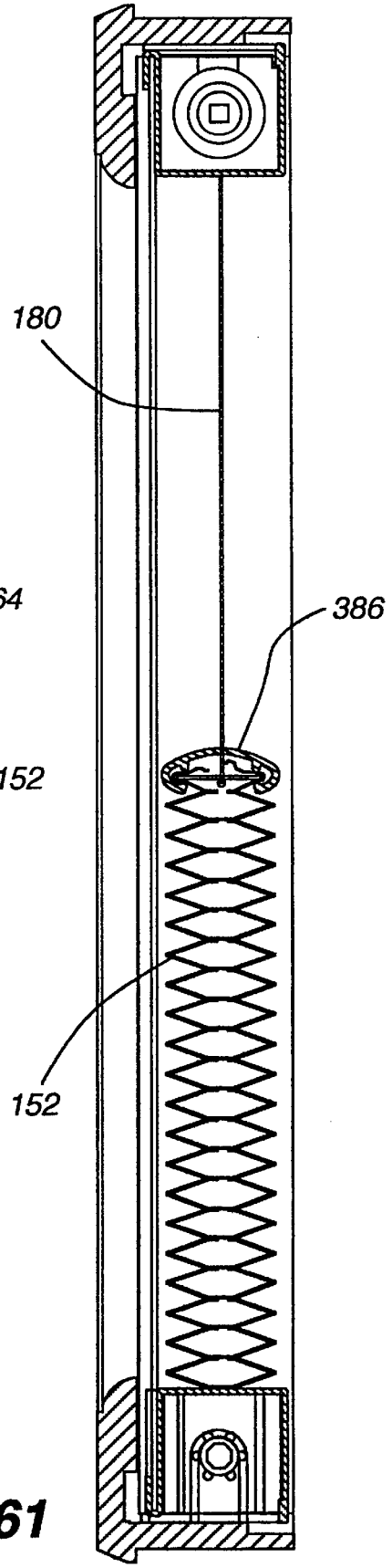
FIG. 61 is an enlarged section taken along line 61—61 of FIG. 60.
Figure 63:
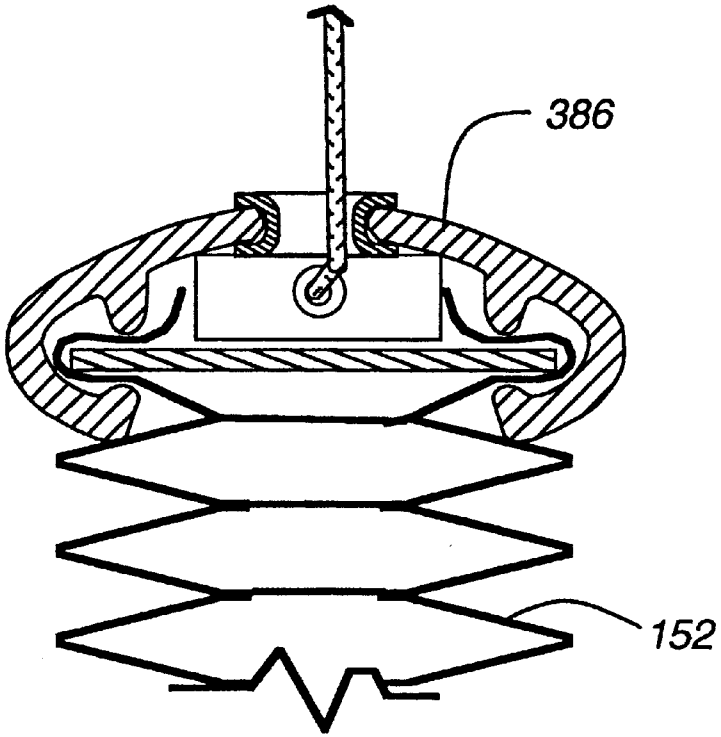
FIG. 63 is an enlarged section taken along line 63—63 of FIG. 60.
Figure 62:
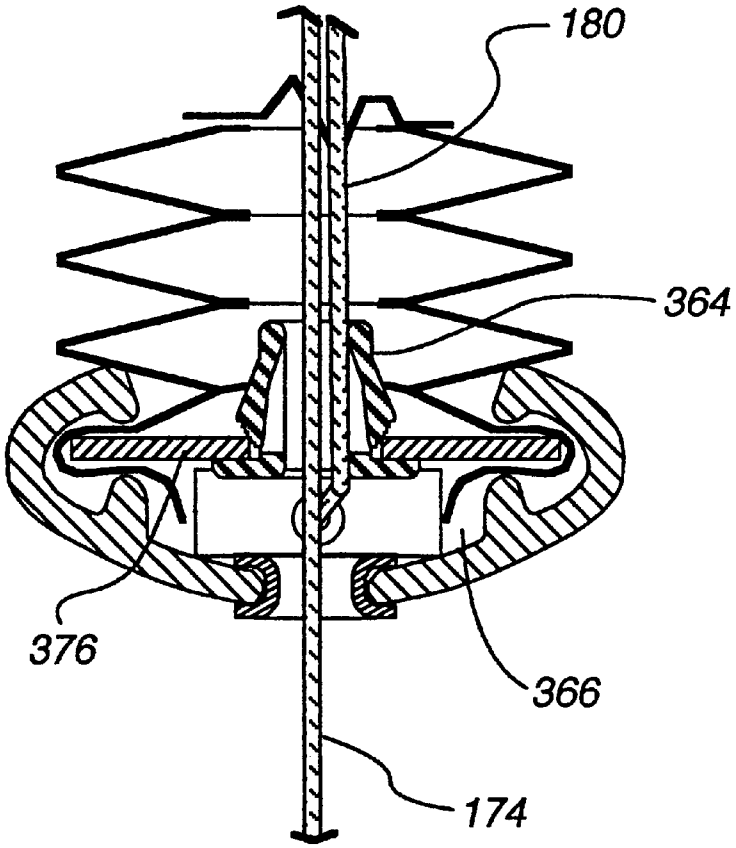
FIG. 62 is an enlarged fragmentary section taken along line 62—62 of FIG. 65.
Figure 64:
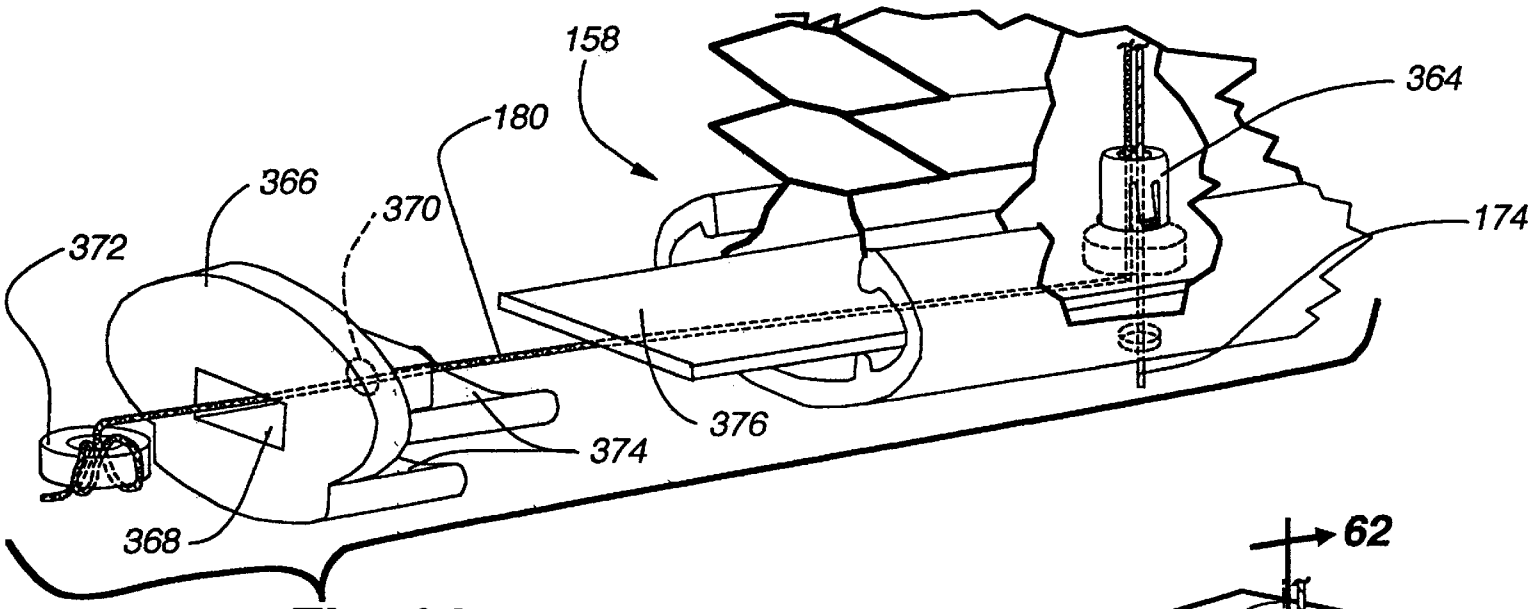
FIG. 64 is an enlarged exploded fragmentary isometric with parts removed showing an end of the bottom rail for the covering shown in FIG. 12.

As shown in FIGS. 60, 61 and 63, the covering could also be operated so that the bottom rail becomes a top rail 386 and is moved upwardly across the opening when extending the curtain 152 across the opening and the curtain 152 becomes retracted adjacent to the bottom of the frame. In this arrangement, the transfer mechanism 162 in the right vertical frame member remains identical as does the cord operating mechanism 160 across the top frame member but the lift cords 180 hang downwardly from the cord spools 178 and are anchored at their lower ends in the top rail 386 that is secured to the uppermost cell of the curtain. In other words, the lift cords would be suspended from the lift spool and would pass downwardly through a grommet 364 in the top rail and be anchored in the end cap 366 of the top rail as described previously in connection with the bottom rail.

The non-moveable end of the curtain, i.e., the top end of the embodiment shown in FIG. 12 and the bottom end of the embodiment shown in FIG. 60, is secured to the exposed face of the U-shaped support channel 184 in any suitable manner such as with an adhesive or the like.

It will be appreciated from the above that a unique covering for an architectural opening has been described wherein a relatively small movement of a finger slide can effect a relatively large movement of the covering across an architectural opening. The covering can be made to move from the top down or from the bottom up utilizing the same components.

Although the present invention has been described with a certain degree of particularity, it is understood that the present disclosure has been made by way of example, and changes in detail or structure may be made without departing from the spirit of the invention as defined in the appended claims.

What is claimed is:

1. The combination of a frame, shade for architectural opening, and a control system for manipulating said shade within said frame, said frame comprising a substantially rigid body having at least one passage therethrough and extending peripherally around said shade, said shade being collapsible and moveable between a closed position wherein the shade substantially fills an area defined by said frame and an open position wherein said shade is collapsed adjacent to said frame, said shade further including a substantially rigid and vertically moveable top rail and said flexible control element is connected to said top rail at two spaced locations such that manipulation of said flexible control element causes the element to selectively lift said top rail to move said shade from its open to its closed position, said shade further including a substantially rigid bottom rail and further including anchor means for securing said bottom rail to said frame, and wherein said control system includes at least one flexible control element secured to said shade and extending through said passage in said frame such that the control element can be manipulated from a location exteriorally of said area defined by said frame to move said shade between said open and closed positions.

2. The combination of a frame, a shade for an architectural opening, and a control system for manipulating said shade within said frame, said frame comprising a substantially rigid body having at least one passage extending therethrough and extending peripherally around said shade, said shade being collapsible and moveable between a closed position wherein the shade substantially fills an area defined by said shade and an open position wherein said shade is collapsed adjacent to said frame, wherein said control system includes at least one flexible control element secured to said shade and extending through said passage in said frame such that the control element can be manipulated from a location exteriorally of said area defined by said frame to move said shade between said open and closed positions, and wherein said shade includes a substantially rigid bottom rail and anchor means for securing said bottom rail to said frame and a substantially rigid and vertically moveable top rail, and wherein said flexible control element is secured to said top rail and to said frame such that manipulation of said control element causes said top rail to be lifted vertically.

3. The combination of claim 2 wherein gravity causes said top rail to be lowered vertically.

4. The combination of claim 3 further including stop means operatively connected to said flexible control element to prevent gravity from lowering said top rail.

5. A covering for an architectural opening comprising in combination:

a frame adapted to be positioned in said architectural opening, a curtain mounted in said frame and adapted to be moved between a retracted position adjacent a side of the frame and an extended position across the architectural opening, and an operating system for moving said curtain between the extended and retracted positions, said operating system including a linearly moveable manually operable operating element and a system for converting the linear movement to a rotational movement for moving said curtain between the extended and retracted positions, said curtain being a collapsible curtain and said system including a rotationally moveable lift cord to lift the curtain in movement between the extended and retracted positions, said operating system including a transfer system for converting linear movement of the operating element into rotational motion, and a cord operating system operatively connected to said transfer system for rotation thereby, said cord operating system including a spool around which said lift cord can be selectively wrapped when lifting said curtain, and wherein said transfer system includes an endless belt that is operatively connected to a roller at the top of said frame for rotating said roller in response to movement of said belt and wherein said operating element is operatively connected to said endless belt to move said belt in response to said linear movement of the operating element, and wherein said cord operating system is operatively connected to said roller to selectively rotate said spool.

6. The covering of claim 5 wherein said spool has a diameter that is greater than the diameter of said roller.

* * * * *